US007293851B2

(12) United States Patent
Nakayama

(10) Patent No.: US 7,293,851 B2
(45) Date of Patent: Nov. 13, 2007

(54) LIQUID DISCHARGING HEAD DRIVE DEVICE AND DRIVE METHOD

(75) Inventor: Kota Nakayama, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 316 days.

(21) Appl. No.: 11/059,753

(22) Filed: Feb. 17, 2005

(65) Prior Publication Data

US 2006/0061608 A1 Mar. 23, 2006

(30) Foreign Application Priority Data

Sep. 22, 2004 (JP) ..... 2004-274919

(51) Int. Cl.
*B41J 29/38* (2006.01)

(52) U.S. Cl. ..... 347/10; 347/9

(58) Field of Classification Search ..... 347/9–10
See application file for complete search history.

(56) References Cited

U.S. PATENT DOCUMENTS

| | | | | |
|---|---|---|---|---|
| 6,243,111 | B1 * | 6/2001 | Imanaka et al. | 347/13 |
| 6,276,773 | B1 * | 8/2001 | Takizawa | 347/10 |
| 6,830,305 | B1 * | 12/2004 | Takizawa | 347/10 |
| 7,084,996 | B2 * | 8/2006 | Kubo | 358/1.15 |
| 2001/0019313 | A1 * | 9/2001 | Takahashi et al. | 341/147 |
| 2005/0116883 | A1 * | 6/2005 | Kondoh | 345/10 |
| 2005/0219290 | A1 * | 10/2005 | Iwao et al. | 347/10 |

FOREIGN PATENT DOCUMENTS

| | | |
|---|---|---|
| JP | 08-281939 | 10/1996 |
| JP | 2001-310461 | 11/2001 |
| JP | 2002-019107 | 1/2002 |
| JP | 2003-251806 | 9/2003 |

OTHER PUBLICATIONS

Smith, Ralph J., Electronics: Circuits and Devices, 1980, John Wiley & Sons, Inc., 2nd ed., pp. 194.*

* cited by examiner

*Primary Examiner*—Hai Pham
*Assistant Examiner*—Kainoa Wright
(74) *Attorney, Agent, or Firm*—Fildes & Outland, P.C.

(57) ABSTRACT

A drive device drives a liquid discharging head to discharge, in accompaniment with the application of a drive signal voltage to a drive element, recording droplets from a nozzle disposed with the drive element. The drive device includes: a fundamental waveform data supply component that generates and supplies plural types of fundamental waveform data representing fundamental waveforms whose voltage level changes in two stages; and a drive signal voltage generation component that generates plural types of fundamental waveform voltages by boosting, to mutually different voltage levels, the plural types of fundamental waveform data supplied from the fundamental waveform data supply component, and which generates a drive signal voltage whose voltage level changes in at least three stages by switching, in accordance with an inputted selection signal, the fundamental waveform voltage to be selectively outputted as the drive signal voltage from the generated plural types of fundamental waveform voltages.

11 Claims, 12 Drawing Sheets

LIQUID DISCHARGING HEAD DRIVE DEVICE AND DRIVE METHOD

CROSS-REFERENCE TO RELATED APPLICATION

This application claims priority under 35 USC 119 from Japanese Patent Application No. 2004-274919, the disclosure of which is incorporated by reference herein.

BACKGROUND OF THE INVENTION

1. Field of the Invention

The present invention relates to a liquid discharging head drive device and drive method, and in particular to a drive device and drive method that drive a liquid discharging head to discharge, in accompaniment with the application of a drive signal voltage to a drive element, recording droplets from a nozzle disposed with that drive element.

2. Description of the Related Art

Conventionally, on-demand printing has been known as one type of inkjet recording method that causes ink droplets discharged from nozzles of a recording head to adhere to a recording medium to record an image of characters or photographs on the recording medium. On-demand printing is a method where ink droplets are intermittently discharged from the nozzles in correspondence to recording information. As one type of on-demand printing, the piezoelectric method is known where the displacement of piezoelectric elements accompanying the application of a drive signal voltage to those piezoelectric elements is transmitted via diaphragms to pressure chambers filled with ink, whereby pressure fluctuations inside the pressure chambers cause ink droplets to be discharged from the nozzles.

In this piezoelectric method, because pressure is added to the ink inside the pressure chambers by the piezoelectric effect of the piezoelectric elements to cause ink droplets to be discharged, when the application of the drive signal voltage to the piezoelectric elements is simply switched ON and OFF (using, as the drive signal voltage applied to the piezoelectric elements, a waveform whose voltage level changes in two stages), problems arise such as satellites and mist occurring. For this reason, in order to suppress the occurrence of satellites and mist by controlling menisci with high precision, a drive signal voltage with a complex waveform (e.g., a waveform whose voltage level changes in at least three stages) becomes necessary. As a configuration to generate such a drive signal voltage, a configuration is conceivable where waveform data defining voltage values of the drive signal voltage at each point in time are converted by a D/A converter to an analog drive signal, with the drive signal being amplified by an amplifier to generate a drive signal voltage. However, in this configuration, it is necessary to dispose numerous D/A converters and amplifiers in correspondence to the numerous piezoelectric elements disposed in the recording head. Thus, there are the problems that the cost of the drive device rises and the size of the drive device becomes large.

In relation to this, Japanese Patent Application Laid-Open Publication (JP-A) No. 2001-310461 discloses technology where the waveform of a drive signal voltage (drive pulse) is used as a waveform comprising the pulse of a first voltage V1 that enlarges the ink channels and the pulse of a second voltage V2 that causes the ink channels to shrink, and where the ratio between the first voltage V1 and the second voltage V2 in the waveform and the continuation time of each pulse are selected to enable high-speed and stable driving of the ink channels.

JP-A No. 8-281939 discloses technology where, in a one-time jetting operation, a stage where a drive signal voltage of a middle level (20V) is applied to the piezoelectric elements (initial stopped state), a stage where a drive signal voltage of a high level (100V) is applied to the piezoelectric elements (jetting stage) and a stage where the drive signal voltage applied to the piezoelectric elements is switched to a low level (0V) (state where post-jetting residual ink is sucked and removed from the nozzle surface) are disposed.

JP-A No. 2002-019107 discloses technology where plural waveform generators are disposed which generate fundamental waveform signals of drive signal voltages in accordance with a parameter signal inputted from a parameter register, and where a predetermined fundamental waveform signal is selected in accordance with a drive signal based on image information from the plural fundamental waveform signals generated by the plural waveform generators.

JP-A No. 2003-251806 discloses technology where, when driving a printing head disposed with plural actuators that drive plural printing elements, a drive waveform outputted from a drive waveform output circuit is outputted to the actuators to drive the actuators, a timing when a large current flows when the drive waveform is applied to the actuators is stored in advance with respect to the drive waveform, and the timing at which the drive waveform is applied is controlled so that times when large currents flow do not overlap between one group of actuators among the plural actuators and another different group of actuators.

In the inkjet recording method, attempts are being made to improve the quality of images recorded on the recording medium, by switching, per individual nozzle (individual piezoelectric element) and in accordance with the image to be recorded, the sizes of the dots formed on the recording medium by the ink droplets discharged from the recording head (dot diameter modulation), and by correcting, per individual piezoelectric element, variations in dot diameter resulting from variations in the characteristics of the individual piezoelectric elements disposed in the recording head (head characteristic correction). In order to realize dot diameter modulation and head characteristic correction, it is necessary to change, in accordance with the diameters of the dots to be formed on the recording medium and the characteristics of the piezoelectric elements, the waveform of the drive signal voltage applied to each piezoelectric element.

With respect to this, the technology described in JP-A No. 2001-310461 uses a waveform whose voltage level is switched in three stages as the drive signal voltage, and there is description in JP-A No. 2001-310461 in regard to selecting the ratio between the first voltage V1 and the second voltage V2 and the continuation time of each pulse; however, the specific circuit configuration for generating the drive signal voltage is not disclosed, and there is the problem that the waveform of the drive signal voltage cannot be changed to a desired waveform, such as generating a drive signal voltage of a waveform where the pulse of the first voltage V1 is added after the pulse of the first voltage V1 and the pulse of the second voltage V2.

In the technology described in JP-A No. 8-281939, the input voltage is divided by a voltage dividing circuit, where plural resistors and plural transistors are combined, to generate three types of voltage values, and the voltage value to be outputted of the three types of generated voltage values is selected by switching the transistors ON and OFF, whereby a drive signal voltage of a waveform whose voltage level is switched in three stages is generated, and it is also possible to change the waveform of the drive signal voltage to a desired waveform by switching the timing and ON and OFF pattern of the plural transistors. However, in the technology described in JP-A No. 8-281939, because it is necessary to dispose numerous voltage dividing circuits in correspondence to the piezoelectric elements in order to switch the waveform of the drive signal voltage using, as a unit, the piezoelectric elements disposed in the recording head, there is the problem that it is easy for variations to arise in the drive signal voltage applied to the piezoelectric elements due to manufacturing variations of the resistors disposed in the voltage dividing circuits. There is also the drawback that the consumption current is large because a through current flows to the voltage dividing circuits depending on the ON and OFF pattern of the plural transistors.

The technology described in JP-A No. 2002-019107 is technology that applies, to piezoelectric elements, a drive signal voltage of a waveform whose voltage level changes in two stages, and it is difficult to control menisci with high precision. Also, in the technology described in JP-A No. 2002-019107, plural types of two-value fundamental waveform signals generated by the plural waveform generators are inputted to selectors disposed in correspondence to the piezoelectric elements of the recording head, and the fundamental waveform signals selected by the selectors are amplified by drivers and applied to the piezoelectric elements as the drive signal voltage. Thus, in this configuration, in order to apply, to the piezoelectric elements, a drive signal voltage of a waveform whose voltage level changes in at least three stages, it is necessary to enable the waveform generators, which are digital circuits that handle two values and comprise a multiplexer, comparator, F/F, timer, zero detector and counter, to generate fundamental waveform signals of waveforms whose voltage level changes in at least three stages, and there is the problem that the configuration of the waveform generators becomes extremely complex.

In the technologies described in JP-A Nos. 2001-310461, 8-281933 and 2002-019107, because consideration is not given to the timing where the drive signal voltage is applied to the piezoelectric elements of the recording head, it is easy for a large current to flow when the drive signal voltages are applied at the same timing to the plural piezoelectric elements, and there is also the potential for an excessive load to act on the drive device. This problem can be solved by applying the technology described in JP-A No. 2003-251806, but with this technology, a storage circuit that stores the timing when the large current flows becomes necessary and a circuit that determines whether or not the launch timings overlap also becomes necessary, so that there is the problem that the configuration becomes complex. The drive control itself is also complex.

SUMMARY OF THE INVENTION

The present invention has been made in view of the above circumstances and provides a liquid discharging head drive device and drive method.

A first aspect of the present invention provides a drive device that drives a liquid discharging head to discharge, in accompaniment with the application of a drive signal voltage to a drive element, recording droplets from a nozzle disposed with the drive element, the drive device including: a fundamental waveform data supply component that generates/supplies plural types of fundamental waveform data representing fundamental waveforms whose voltage level changes in two stages; and a drive signal voltage generation component that generates plural types of fundamental waveform voltages by boosting, to mutually different voltage levels, the plural types of fundamental waveform data supplied from the fundamental waveform data supply component, and which generates a drive signal voltage whose voltage level changes in at least three stages by switching, in accordance with an inputted selection signal, the fundamental waveform voltage to be selectively outputted as the drive signal voltage from the generated plural types of fundamental waveform voltages.

A second aspect of the present invention provides a method of driving a liquid discharging head to discharge, in accompaniment with the application of a drive signal voltage to a drive element, recording droplets from a nozzle disposed with that drive element, the drive method including: generating/supplying plural types of fundamental waveform data representing fundamental waveforms whose voltage level changes in two stages; and generating plural types of fundamental waveform voltages by boosting, to mutually different voltage levels, the supplied plural types of fundamental waveform data, and generating a drive signal voltage whose voltage level changes in at least three stages by switching, in accordance with an inputted selection signal, the fundamental waveform voltage to be selectively outputted as the drive signal voltage from the generated plural types of fundamental waveform voltages.

As described above, the present invention is configured to generate/supply plural types of fundamental waveform data representing fundamental waveforms whose voltage level changes in two stages, generate plural types of fundamental waveform voltages by boosting, to mutually different voltage levels, the plural types of fundamental waveform data, and generate a drive signal voltage whose voltage level changes in three stages by switching, in accordance with an inputted selection signal, the fundamental waveform voltage to be selectively outputted as the drive signal voltage from the generated plural types of fundamental waveform voltages. Thus, the invention has the excellent effect that generating a drive signal voltage of a desired waveform whose voltage level changes in at least three stages can be realized with a simple configuration.

BRIEF DESCRIPTION OF THE DRAWINGS

Preferred embodiments of the present invention will be described in detail based on the following figures, wherein.

DETAILED DESCRIPTION OF THE INVENTION

First Embodiment

Figure 1:
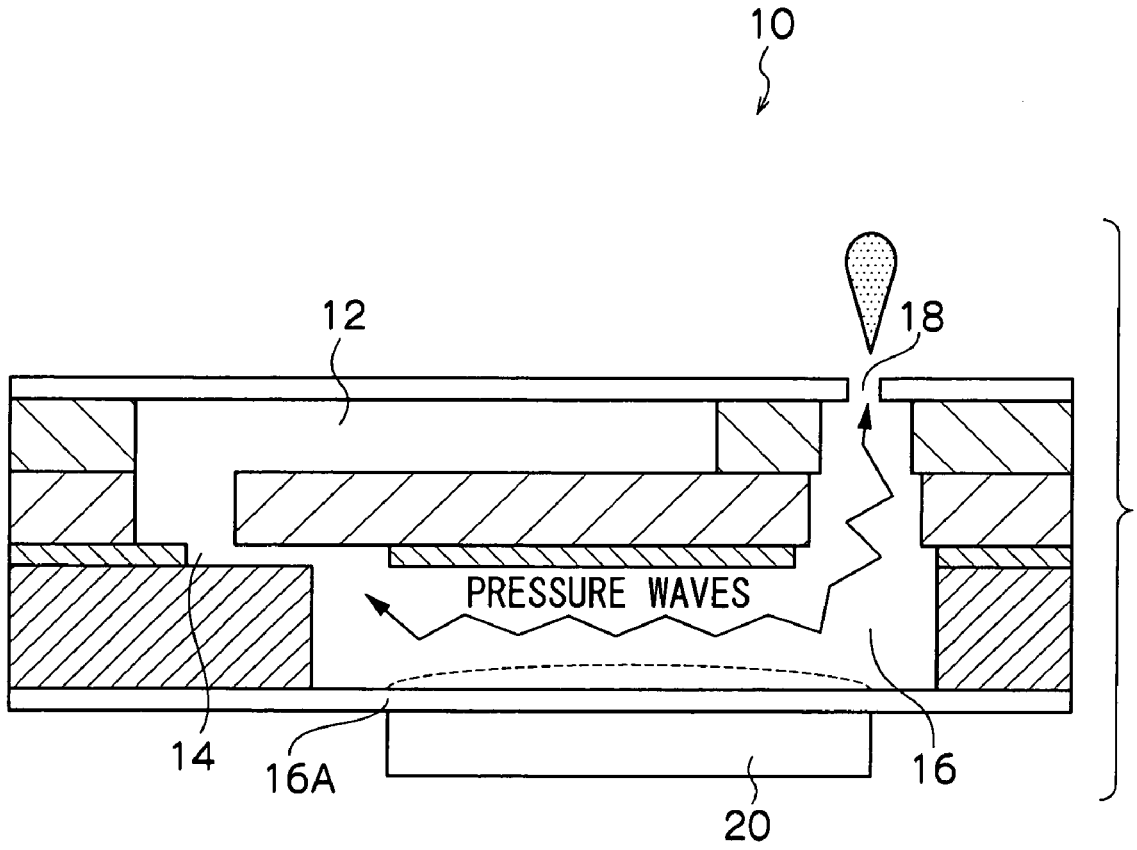
FIG. 1 is a cross-sectional diagram showing the internal structure of a liquid discharging head pertaining to embodiments of the present invention.

Embodiments of the invention will be described in detail below with reference to the drawings. FIG. 1 shows the internal structure of a liquid discharging head 10 of an inkjet printer device pertaining to the present invention. Numerous nozzles are actually disposed in the liquid discharging head 10, but because the portions corresponding to the nozzles all share the same structure, FIG. 1 shows only the portion corresponding to one nozzle.

As shown in FIG. 1, an ink tank 12 is disposed in the liquid discharging head 10, and ink supplied via an ink supply path is retained in the ink tank 12. The ink tank 12 communicates with a pressure chamber 16 via a supply path 14, and the pressure chamber 16 is filled with ink supplied from the ink tank 12 via the supply path 14. Part of a wall surface of the pressure chamber 16 is configured by a diaphragm 16A, and a piezoelectric element 20 serving as a drive element pertaining to the invention is joined to the diaphragm 16A by adhesion or the like. When a voltage (later-described drive signal voltage) is applied to the piezoelectric element 20, the piezoelectric element 20 is displaced, whereby the diaphragm 16A vibrates, the vibrations of the diaphragm 16A propagate through the inside of the pressure chamber 16 as pressure waves, and the ink inside the pressure chamber 16 is discharged as ink droplets via a nozzle 18 that communicates with the pressure chamber 16.

Figure 2:
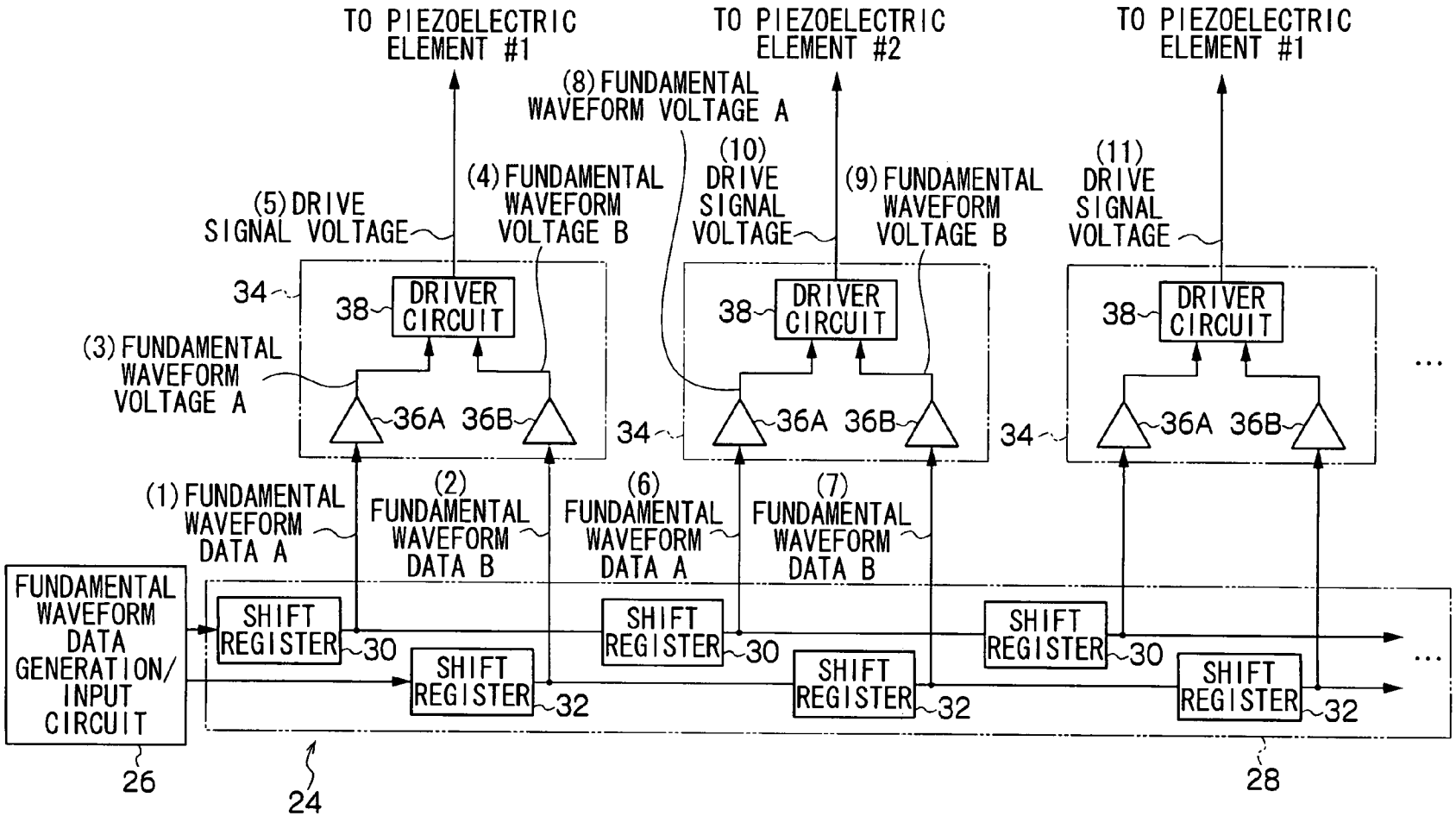
FIG. 2 is a block diagram showing the schematic configuration of a head drive unit pertaining to a first embodiment of the present invention.

FIG. 2 shows a head drive unit 24 pertaining to a first embodiment of the present invention. The head drive unit 24 is built into the inkjet printer device, drives the liquid discharging head 10, and corresponds to a liquid discharging head drive device pertaining to the invention. The head drive unit 24 includes: numerous drive signal voltage generators 34 disposed in correspondence to the piezoelectric elements 20 of the liquid discharging head 10; a fundamental waveform data generation/input circuit 26 that generates plural types of fundamental waveform data; and a shift register group 28 that transfers, and supplies to the individual drive signal voltage generators 34, the plural types of fundamental waveform data generated by the fundamental waveform data generation/input circuit 26. The drive signal voltage generators 34 correspond to a drive signal voltage generation component pertaining to the present invention, and the fundamental waveform data generation/input circuit 26 and the shift register group 28 correspond to a fundamental waveform data supply component pertaining to the invention.

Figure 5:
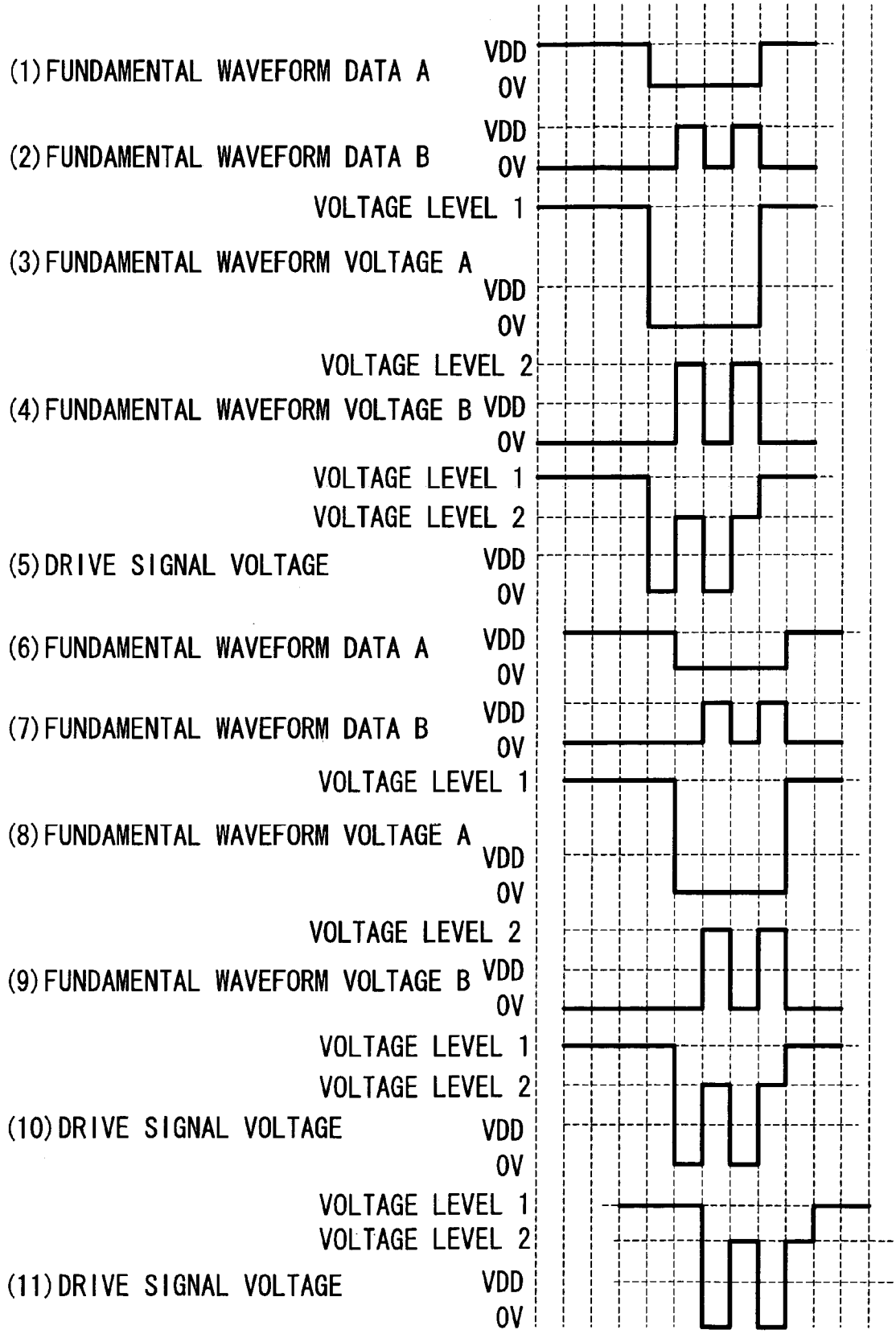
FIG. 5 is a timing chart of data (voltages) flowing through each part of the head drive unit pertaining to the first embodiment of the present invention.

In the present embodiment, the fundamental waveform data are data representing fundamental waveforms whose voltage level changes in two stages (waveforms serving as the basis of the drive signal voltages; e.g., see FIG. 5(1)). When the voltage level of the corresponding fundamental waveform is a low level (e.g., 0 (V)), the value is "0", and when the voltage level of the corresponding fundamental waveform is a high level (e.g., VDD (V)), the value is "1". Thus, the voltage level at the timing of the change in the voltage level of the corresponding fundamental waveform and during that change timing is represented by two values. The fundamental waveform data generation/input circuit 26 stores the fundamental waveform data in a built-in memory, and repeatedly reads and outputs, one bit at a time, the fundamental waveform data from the built-in memory at a timing synchronized with a predetermined clock signal (e.g., if the value of the read bit is "0", then the output voltage level becomes 0 (V), and if the value of the read bit is "1", then the output voltage level becomes VDD (V)).

Two types of fundamental waveform data representing mutually different waveforms are stored in the built-in memory of the fundamental waveform data generation/input circuit 26 (for convenience, one of the two types of fundamental waveform data will be called "fundamental waveform data A" and the other will be called "fundamental waveform data B" below). As described later, the two types of fundamental waveform data are inputted to the drive signal voltage generators 34. In the drive signal voltage generators 34, the two types of fundamental waveform data are boosted to mutually different voltage levels, and of the boosted two types of fundamental waveform voltages, the fundamental waveform voltage selectively outputted as the drive signal voltage is appropriately switched, whereby a drive signal voltage whose voltage level changes in at least three stages is generated. The two types of fundamental waveform data represent mutually different fundamental waveforms determined so that a drive signal voltage of a desired waveform is obtained (e.g., see FIGS. 5(1) and (2)). The fundamental waveform data generation/input circuit 26 repeatedly reads and outputs, one bit at a time, the fundamental waveform data A and B stored in the built-in memory.

The fundamental waveform data A and B outputted from the fundamental waveform data generation/input circuit 26 are inputted to the shift register group 28. Disposed in the shift register group 28 are a shift register row A, where numerous shift registers 30 disposed in correspondence to the drive signal voltage generators 34 are serially connected, and a shift register row B, where numerous shift registers 32 disposed in correspondence to the drive signal voltage generators 34 are serially connected. The fundamental waveform data A inputted one bit at a time to the shift register group 28 are inputted to the shift register row A and transferred in order through the shift register row A in a cycle synchronized with a predetermined clock signal. Similarly, the fundamental waveform data B inputted one bit at a time to the shift register group 28 are inputted to the shift register row B and transferred in order through the shift register row B in a cycle synchronized with a predetermined clock signal.

Output ends of the shift registers 30 of the shift register row A are connected to input ends of booster circuits 36A of corresponding drive signal voltage generators 34, and output ends of the shift registers 32 of the shift register row B are connected to input ends of booster circuits 36B of corresponding drive signal voltage generators 34. Thus, as will be apparent by comparing FIGS. 5(1) and (2) with FIGS. 5(6) and (7) (the waveform shown in FIG. 5(*x*) represents the waveform of data (voltage) flowing through a place represented by (x) in the head drive unit 24 shown in FIG. 2), the fundamental waveform data A and B are inputted to the drive signal voltage generators 34 at timings shifted one cycle of a predetermined clock signal.

As shown in FIG. 5(3), for example, the booster circuit 36A boosts the inputted fundamental waveform data A to a predetermined voltage level (voltage level 1) to generate a fundamental waveform voltage A. And as shown in FIG. 5(4), for example, the booster circuit 36B boosts the inputted fundamental waveform data B to a voltage level (voltage level 2) different from that of the booster circuit 36A to generate a fundamental waveform voltage B. Output ends of the booster circuits 36A and 36B are connected to input ends of driver circuits 38, and the fundamental waveform voltages A and B generated by the booster circuits 36A and 36B are inputted to the driver circuits 38.

Figure 3A:
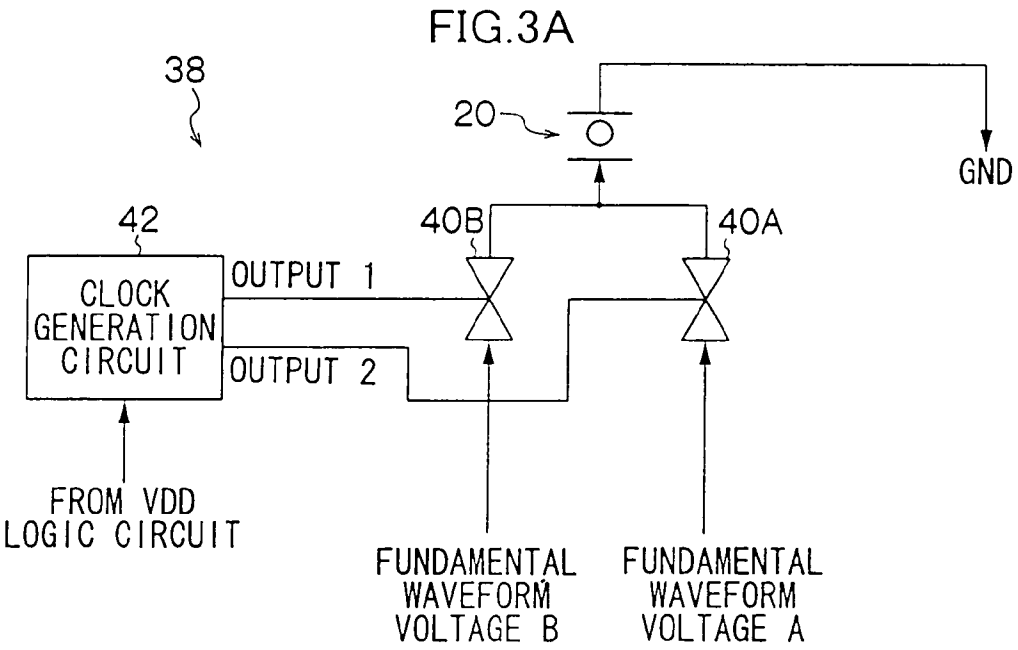
FIG. 3A is a block diagram showing the schematic configuration of a driver circuit.

As shown in FIG. 3A, each driver circuit 38 is disposed with transfer gates 40A and 40B. The fundamental waveform voltage A inputted to the driver circuit 38 is inputted to an input end of the transfer gate 40A, and the fundamental waveform voltage B inputted to the driver circuit 38 is inputted to an input end of the transfer gate 40B. Output ends of the transfer gates 40A and 40B are connected to one end of the piezoelectric element 20, and the other end of the piezoelectric element 20 is grounded. Also, control signal input ends of the transfer gates 40A and 40B are connected to a clock generation circuit 42. The transfer gates 40A and 40B are ON only when signals inputted via the control signal input ends are of a high level, and the transfer gates 40A and 40B output, as drive signal voltages from output ends, fundamental waveform voltages inputted via the input ends.

Figure 3B:
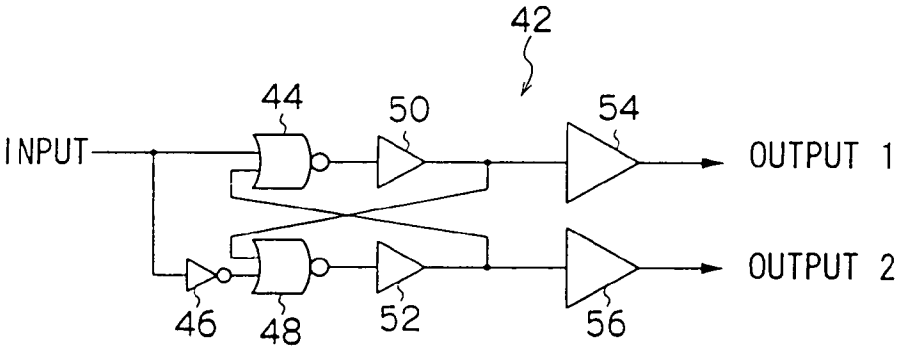
FIG. 3B is a block diagram showing the schematic configuration of a clock generation circuit.

As shown in FIG. 3B, the input signal line of the clock generation circuit 42 branches into two, with one line being connected to one of two input ends of a NOR circuit 44 and the other line being connected to one of two input ends of a NOR circuit 48 via a NOT circuit (inverter) 46. An output end of the NOR circuit 44 is connected to an input end of a delay circuit 50, and an output end of the delay circuit 50 is connected to an input end of a level shifter 54 and the other of the two input ends of the NOR circuit 48. An output end of the NOR circuit 48 is connected to an input end of a delay circuit 52, and an output end of the delay circuit 52 is connected to an input end of a level shifter 56 and the other of the two input ends of the NOR circuit 44. An output end of the level shifter 54 is connected to the control signal input end of the transfer gate 40A, and an output end of the level shifter 56 is connected to the control signal input end of the transfer gate 40B.

Next, the action of the first embodiment will be described. When ink droplets are to be discharged from the liquid discharging heads 10, the fundamental waveform data generation/input circuit 26 of the head drive unit 24 repeatedly reads, one bit at a time, and outputs in order the fundamental waveform data A and B stored in the built-in memory at a timing synchronized with a predetermined clock signal. The fundamental waveform data A outputted one bit at a time from the fundamental waveform data generation/input circuit 26 are sequentially inputted to the shift register row A comprising the numerous shift registers 30, transferred in order through the shift register row A in a cycle synchronized with a predetermined clock signal, and inputted to the booster circuits 36A of the drive signal voltage generators 34 at timings shifted one cycle of a predetermined clock signal (see FIGS. 5(1) and (6)). Also, the fundamental waveform data B outputted one bit at a time from the fundamental waveform data generation/input circuit 26 are sequentially inputted to the shift register row B comprising the numerous shift registers 32, transferred in order through the shift register row B in a cycle synchronized with a predetermined clock signal, and inputted to the booster circuits 36B of the drive signal voltage generators 34 at timings shifted one cycle of a predetermined clock signal (see FIGS. 5(2) and (7)).

The fundamental waveform data A inputted to the booster circuits 36A of the drive signal voltage generators 34 are boosted by the booster circuits 36A to a predetermined voltage level (voltage level 1) and inputted to the driver circuits 38 as the fundamental waveform voltage A (see FIGS. 5(3) and (8)). Also, the fundamental waveform data B inputted to the booster circuits 36B of the drive signal voltage generators 34 are boosted by the booster circuits 36B to a predetermined voltage level (voltage level 2) different from that of the fundamental waveform voltage A and inputted to the driver circuits 38 as the fundamental waveform voltage B (see FIGS. 5(4) and (9)).

In the present embodiment, the fundamental waveform data A inputted to the booster circuits 36A are also inputted as signals to the clock generation circuits 42 of the driver circuits 38. When the signals inputted to the two input ends of the NOR circuits 44 and 48 of the clock generation circuit 42 are "0" (low level: 0 (V)), then the output signals become "1" (high level: VDD (V)), and in cases other than this, the output signals become "0" (low level). Thus, basically, when the signal inputted to the clock generation circuit 42 is "0", the signal outputted via the level shifter 54 (output 1) becomes "1" (high level) and the signal outputted via the level shifter 56 (output 2) becomes "0" (low level).

Figure 4:
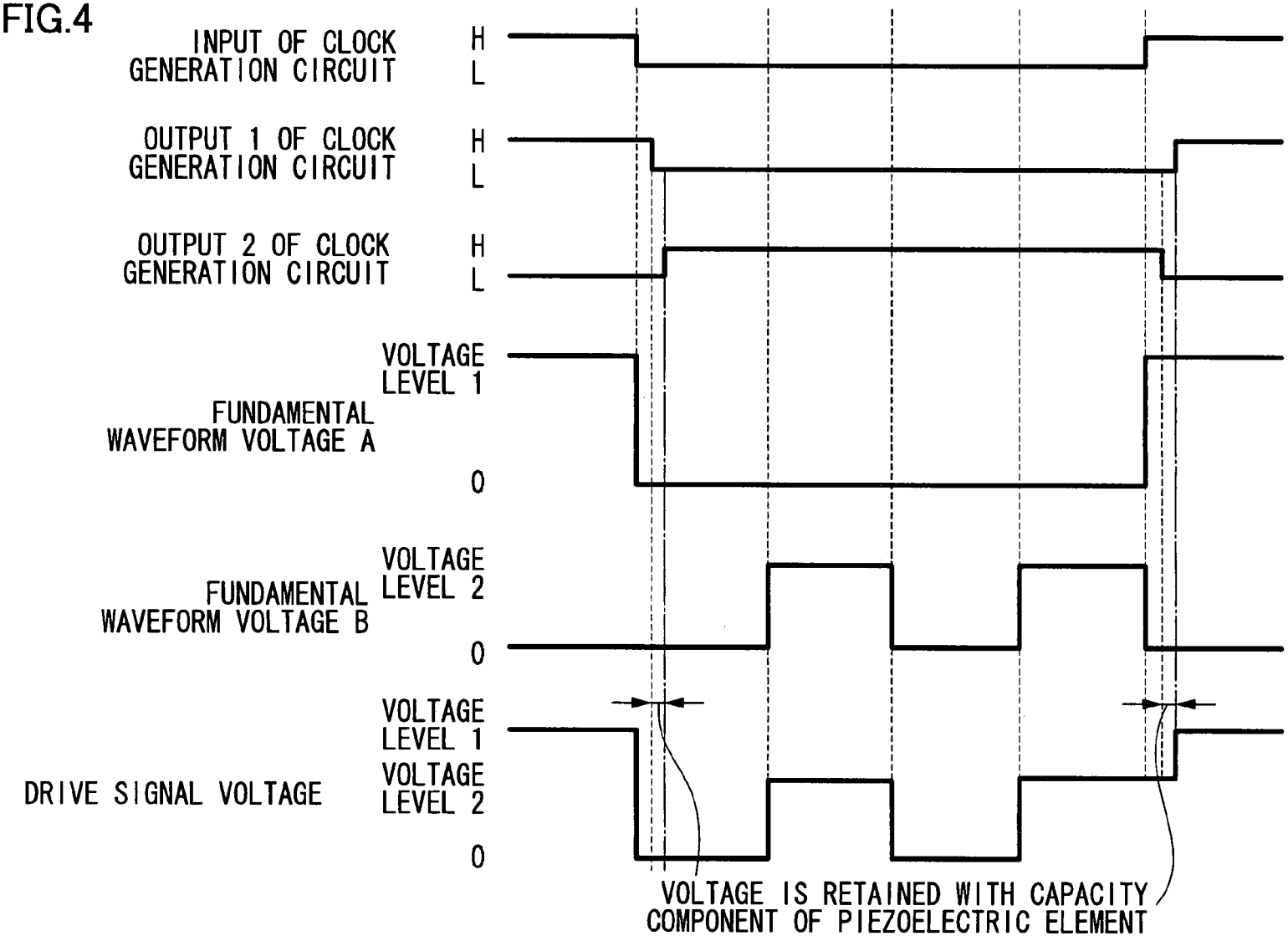
FIG. 4 is a timing chart for describing the operation of the driver circuit.

When the signals (outputs 1 and 2) inputted to the control signal input ends of the transfer gates 40A and 40B are "1" (high level), the transfer gates 40A and 40B output the inputted fundamental waveform voltages as drive signal voltages. Thus, the drive signal voltages outputted from the transfer gates 40A and 40B become a waveform whose voltage level changes in three stages as shown in FIG. 4 (see also FIGS. 5(10) and (11)), and the drive signal voltage of this waveform acts on the piezoelectric element 20, whereby the piezoelectric element 20 is displaced, the diaphragm 16A vibrates, the vibrations of the diaphragm 16A propagate through the inside of the pressure chamber 16 as pressure waves, and the ink inside the pressure chamber 16 is discharged as ink droplets from the nozzle 18.

Also, the delay circuits 50 and 52 are disposed between the NOR circuit 44 and the level shifter 54 and between the NOR circuit 48 and the level shifter 56 in the clock generation circuit 42. Thus, as shown in FIG. 4, when the signal inputted to the clock generation circuit 42 has been changed from "1" to "0", the output 1 is delayed for a delay time by the delay circuit 50 and changed from "1" to "0", and the change in the level is inputted to the NOR circuit 48, whereby the level of the output signal of the NOR circuit 48 is changed. Thus, the output 2 is delayed for a delay time by the delay circuit 52 after the level of the output 1 has been changed, and is changed from "0" to "1". Also, when the signal inputted to the clock generation circuit 42 has been changed from "0" to "1", and the change in the level is inputted to the NOR circuit 44, whereby the level of the output signal of the NOR circuit 44 is changed. Thus, the output 1 is delayed for a delay time by the delay circuit 50 after the level of the output 2 has been changed, and is changed from "0" to "1".

Therefore, the levels of the signals (outputs 1 and 2) inputted to the control signal input ends of the transfer gates 40A and 40B are switched after a state where the levels of the signals are "0" continues for a predetermined time (time corresponding to the delay time resulting from the delay circuits 50 and 52). Thus, even when the voltage outputted from the transfer gates 40A and 40B as the drive signal voltage is to be switched from the fundamental waveform voltage A to the fundamental waveform voltage B, or vice versa, a state where neither of the fundamental waveform voltages A and B is outputted as the drive signal voltage continues for a predetermined time. When the transfer gates 40A and 40B are ON, there is the potential for back-flow of the current from the power source supplying the voltage level 1 to the power source supplying the voltage level 2 to arise, but by conducting the above control, a situation where a state arises where the transfer gates 40A and 40B are ON can be reliably prevented, and back-flow of the current can be reliably prevented. In this manner, the clock generation circuit 42 corresponds to a selection signal generating component of the invention.

It will be noted that because the piezoelectric elements 20 are substantially electrically equivalent to capacitors, when the voltage outputted as the drive signal voltage from the transfer gates 40A and 40B is to be switched from the fundamental waveform voltage A to the fundamental waveform voltage B, or vice versa, even if a state where neither of the fundamental waveform voltages A and B is outputted as the drive signal voltage is continued for a predetermined time, the change (change in the voltage applied to both ends of the piezoelectric elements 20) in the drive signal voltage during the no-output period when neither or the fundamental waveform voltages A and B is outputted as the drive signal voltage is slight, and the no-output period does not adversely affect the driving of the piezoelectric elements 20.

In this manner, in the first embodiment, the fundamental waveform data A and B, whose voltage level changes in two stages and which are mutually different, are stored in the built-in memory of the fundamental waveform generation/input circuit 26, read and transferred in order one bit at a time from the built-in memory, inputted to the drive signal voltage generators 34 corresponding to the piezoelectric elements 20, and boosted to mutually different voltage levels to generate the fundamental waveform voltages A and B. The fundamental waveform voltage to be outputted as the drive signal voltage of the fundamental waveform voltages A and B is appropriately switched, to thereby generate a drive signal voltage whose voltage level changes in three stages. Thus, the waveform of the drive signal voltage can be optionally changed by the simple processing of transferring the fundamental waveform data A and B, the waveform can be made into a waveform where the meniscus can be controlled with high precision, and changing the waveform of the drive signal voltage for dot diameter modulation and head characteristic correction can also be easily realized.

Also, in the first embodiment, the fundamental waveform data generation/input circuit 26 does not output data representing a waveform whose voltage level changes in three stages, but outputs plural types of data (the fundamental waveform data A and B) representing waveforms whose voltage levels change in two stages, whereby a drive signal voltage whose voltage level changes in three stages can be generated. Thus, the configuration of the fundamental waveform data generation/input circuit 26 can be simplified.

Also, in the first embodiment, the fundamental waveform data A and B sequentially outputted one bit at a time from the fundamental waveform data generation/input circuit 26 are sequentially transferred by the shift register rows A and B and inputted to the drive signal voltage generators 34 corresponding to the piezoelectric elements 20, whereby the timings at which the fundamental waveform data A and B are inputted to the drive signal voltage generators 34 are shifted one cycle of a predetermined clock signal. Thus, the timings at which the drive signal voltages are outputted from the drive signal voltage generators 34 and applied to the piezoelectric elements 20 are also shifted one cycle of a predetermined clock signal (see FIGS. 5(10) and (11)), and the peak current can also be prevented from becoming excessive.

Second Embodiment

Figure 6:
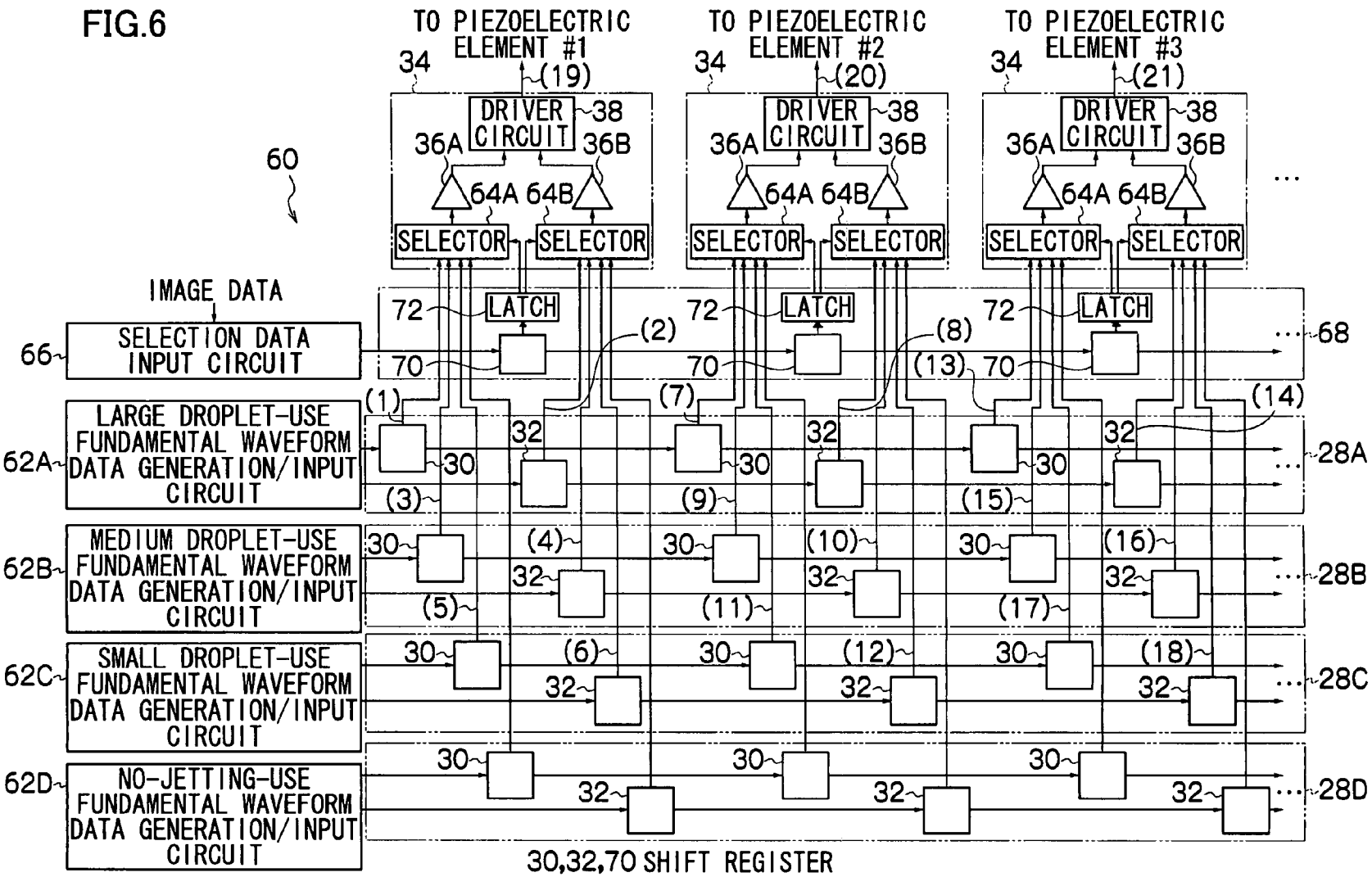
FIG. 6 is a block diagram showing the schematic configuration of a head drive unit pertaining to a second embodiment of the present invention.

Next, a second embodiment of the present invention will be described. The same reference numerals will be given to portions that are the same as those of the first embodiment, and description of those portions will be omitted. As shown in FIG. 6, instead of the previously described fundamental waveform data generation/input circuit 26 of the first embodiment, a head drive unit 60 pertaining to the second embodiment is disposed with a large droplet-use fundamental waveform data generation/input circuit 62A, a medium droplet-use fundamental waveform data generation/input circuit 62B, a small droplet-use fundamental waveform data generation/input circuit 62C and a no-jetting-use fundamental waveform data generation/input circuit 62D. Four of the shift register group 28 (shift register groups 28A to 28D) described in the first embodiment are disposed in correspondence to these fundamental waveform data generation/input circuits 62A to 62D.

The fundamental waveform data generation/input circuits 62A to 62D have substantially the same configuration as the fundamental waveform data generation/input circuit 26 described in the first embodiment, except that the fundamental waveform data A and B stored in the built-in memories are different from each other. In the built-in memory of the large droplet-use fundamental waveform data generation/input circuit 62A are stored large droplet-use fundamental waveform data A and B (see FIGS. 7(1) and (2)) for generating a drive signal voltage of a waveform to be applied to the piezoelectric elements 20 in order to cause ink droplets of relatively large droplet quantities (large droplets) to be discharged from the nozzles 18. In the built-in memory of the medium droplet-use fundamental waveform data generation/input circuit 62B are stored medium droplet-use fundamental waveform data A and B (see FIGS. 7(3) and (4)) for generating a drive signal voltage of a waveform to be applied to the piezoelectric elements 20 in order to cause ink droplets of medium droplet quantities (medium droplets) to be discharged from the nozzles 18. In the built-in memory of the small droplet-use fundamental waveform data generation/input circuit 62C are stored small droplet-use fundamental waveform data A and B (see FIGS. 7(5) and (6)) for generating a drive signal voltage of a waveform to be applied to the piezoelectric elements 20 in order to cause ink droplets of relatively small droplet quantities (small droplets) to be discharged from the nozzles 18. And in the built-in memory of the no-jetting-use fundamental waveform data generation/input circuit 62D are stored no-jetting-use fundamental waveform data A and B for generating a drive signal voltage of a waveform to be applied to the piezoelectric elements 20 in order to prevent the ink from fixing when ink droplets are not discharged from the nozzles 18.

Selectors 64A and 64B are disposed in each of the drive signal voltage generators 34 corresponding to the piezoelectric elements 20. The input ends of the booster circuits 36A are connected to output ends of the selectors 64A, and the input ends of the booster circuits 36B are connected to output ends of the selectors 64B. The output ends of the shift registers 30 of the shift register groups 28A to 28D are connected to input ends of the selectors 64A of the corresponding drive signal voltage generators 34, and the output ends of the shift registers 32 of the shift register groups 28A to 28D are connected to input ends of the selectors 64B of the corresponding drive signal voltage generators 34.

In the head drive unit 60 pertaining to the second embodiment, the large droplet-use fundamental waveform data A and B outputted from the large droplet-use fundamental waveform data generation/input circuit 62A are transferred by the shift register group 28A, the medium droplet-use fundamental waveform data A and B outputted from the medium droplet-use fundamental waveform data generation/input circuit 62B are transferred by the shift register group 28B, the small droplet-use fundamental waveform data A and B outputted from the small droplet-use fundamental waveform data generation/input circuit 62C are transferred by the shift register group 28C, and the no-jetting-use fundamental waveform data A and B outputted from the no-jetting-use fundamental waveform data generation/input circuit 62D are transferred by the shift register group 28D. Thus, the large droplet-use, medium droplet-use, small droplet-use and no-jetting-use fundamental waveform data A are inputted to the selectors 64A of the drive signal voltage generators 34, and the large droplet-use, medium droplet-use, small droplet-use and no-jetting-use fundamental waveform data B are inputted to the selectors 64B of the drive signal voltage generators 34.

The head drive unit 60 pertaining to the second embodiment is also disposed with a selection data input circuit 66. Image data representing an image to be formed on a recording medium by causing ink droplets to be discharged from the nozzles 18 of the liquid discharging head 10 are inputted to the selection data input circuit 66. The selection data input circuit 66 determines, on the basis of the inputted image data, from which of the nozzles 18 ink droplets are to be discharged and the droplet quantity of the ink droplets (large droplets, medium droplets, small droplets) to be discharged. On the basis of the result of this determination, the selection data input circuit 66 generates selection data instructing, for each drive signal voltage generator 34, which of the large droplet-use, medium droplet-use, small droplet-use and no-jetting-use fundamental waveform data inputted to the selectors 64A and 64B to select (to be used to drive the piezoelectric elements 20), and sequentially outputs the generated selection data using, as a unit, the selection data corresponding to a single drive signal voltage generator 34. The aforementioned selection data correspond to selection data of the invention.

A data transfer input unit 68 is connected to the output end of the selection data input circuit 66. The data transfer input unit 68 includes numerous shift registers 70 that are disposed in correspondence to the drive signal voltage generators 34 and are serially connected to form a shift register row. The data transfer input unit 68 is configured by this shift register row, which transfer selection data sequentially outputted from the selection data input circuit 66, and by numerous latches 72, which are connected to output ends of the shift registers 70 of the shift register row, retain the selection data outputted from the shift registers 70 and input the selection data to the control signal input ends of the selectors 64A and 64B.

In the second embodiment, the fundamental waveform data generation/input circuits 62A to 62D and the shift register groups 28A to 28D correspond to a fundamental waveform data supply component of the present invention, and the selectors 64A and 64B and the data transfer input unit 68 correspond to a first selection component of the present invention.

Next, the action of the second embodiment will be described. In the head drive unit 60 pertaining to the second embodiment, selection data are generated and sequentially outputted on the basis of image data by the selection data input circuit 66 prior to the discharging of the ink droplets from the liquid discharging head 10. The selection data sequentially outputted from the selection data input circuit 66 are transferred by the shift register row of the data transfer input unit 68 and retained in the latches 72, whereby the selection data are inputted to the selectors 64A and 64B of the corresponding drive signal voltage generators 34.

Also, the fundamental waveform data generation/input circuits 62A to 62D repeatedly read, one bit at a time, and output in order the fundamental waveform data A and B (any of the large droplet-use, medium droplet-use, small droplet-use and no-jetting-use) stored in the built-in memories at a timing synchronized with a predetermined clock signal. The large droplet-use, medium droplet-use, small droplet-use and no-jetting-use fundamental waveform data A outputted from the fundamental waveform data generation/input circuits 62A to 62D are transferred by the shift register rows A of the shift register groups 28A to 28D and inputted to the selectors 64A of the drive signal voltage generators 34 at a timing shifted one cycle of a predetermined clock signal. Also, the large droplet-use, medium droplet-use, small droplet-use and no-jetting-use fundamental waveform data B outputted from the fundamental waveform data generation/input circuits 62A to 62D are transferred by the shift register rows B of the shift register groups 28A to 28D and inputted to the selectors 64B of the drive signal voltage generators 34 at a timing shifted one cycle of a predetermined clock signal.

Of the large droplet-use, medium droplet-use, small droplet-use and no-jetting-use fundamental waveform data inputted via the shift register groups 28A to 28D from the fundamental waveform data generation/input circuits 62A to 62D, the selectors 64A and 64B output, to the booster circuits 36A and 36B, the fundamental waveform data for which selection has been instructed by the selection data inputted to the control signal input ends via the data transfer input unit 68 from the selection data input circuit 66.

Figure 7:
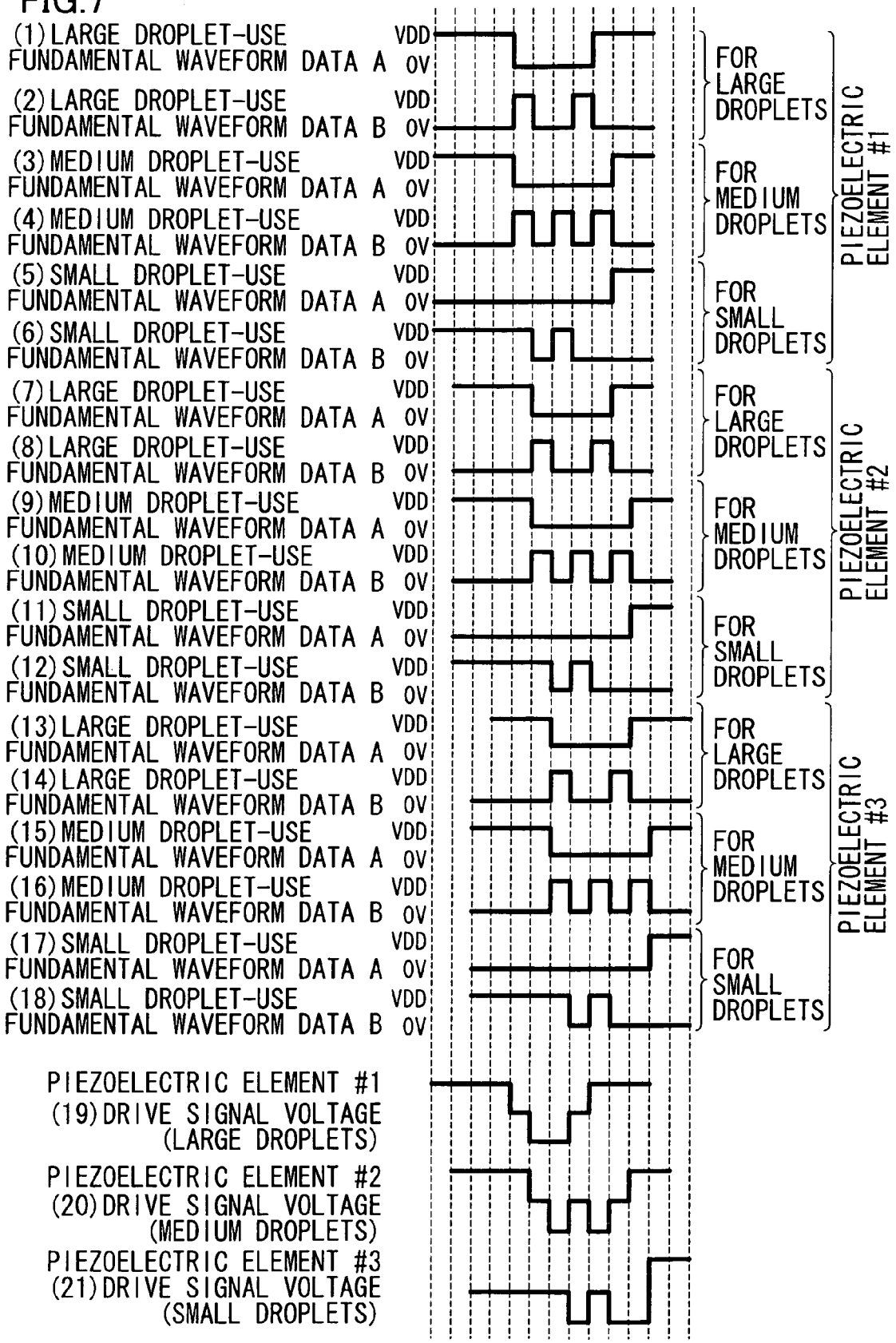
FIG. 7 is a timing chart of data (voltages) flowing through each part of the head drive unit pertaining to the second embodiment of the present invention.

Thus, as shown in FIGS. 7(19) to (21), for example, on the basis of the fundamental waveform data outputted from the selectors 64A and 64B, the drive signal voltages outputted via the booster circuits 36A and 36B and the driver circuits 38 and applied to the piezoelectric elements 20 become waveforms corresponding to the type (large droplet-use, medium droplet-use, small droplet-use, and no-jetting-use) of fundamental waveform data outputted from the selectors 64A and 64B, and the waveforms of the drive signal voltages applied to the piezoelectric elements 20 are independently controlled for each piezoelectric element 20 in accordance with the selection data inputted to the selectors 64A and 64B of the drive signal voltage generators 34 corresponding to the piezoelectric elements 20. FIGS. 7(19) to (21) show cases where, with respect to piezoelectric element #1, a drive signal voltage of a large droplet-use waveform is generated/applied as a result of large droplet-use fundamental waveform data being selected, and with respect to piezoelectric element #2, a drive signal voltage of a medium droplet-use waveform is generated/applied as a result of medium droplet-use fundamental waveform data being selected, and with respect to piezoelectric element #3, a drive signal voltage of a small droplet-use waveform is generated/applied as a result of small droplet-use fundamental waveform data being selected.

As for from which of the nozzles 18 of the liquid discharging head 10 ink droplets are to be discharged and the droplet quantities of the ink droplets to be discharged, these are dependent on the waveforms of the drive signal voltages applied to the corresponding piezoelectric elements 20, and the sizes of the dots formed on the recording medium by the ink droplets discharged from the nozzles 18 are dependent on the droplet quantities of the ink droplets discharged from the nozzles 18. Thus, the head drive unit 60 pertaining to the second embodiment switches the droplet quantities of the ink droplets discharged from the nozzles 18, whereby dot diameter modulation, in which the sizes of the dots formed on the recording medium by the ink droplets discharged from the nozzles 18 is switched for each nozzle 18 (each piezoelectric element) in accordance with the image to be formed on the recording medium, can be realized, and high image quality of the image formed on the recording medium can be realized by this dot diameter modulation.

In the second embodiment also, the large droplet-use, medium droplet-use, small droplet-use and no-jetting-use fundamental waveform data A and B sequentially outputted one bit at a time from the fundamental waveform data generation/input circuits 62A to 62D are sequentially transferred by the shift register groups 28A to 28D and inputted to the drive signal voltage generators 34 corresponding to the piezoelectric elements 20, whereby the timings at which the large droplet-use, medium droplet-use, small droplet-use and no-jetting-use fundamental waveform data A and B are inputted to the drive signal voltage generators 34 are shifted one cycle of a predetermined clock signal. Thus, the timings at which the drive signal voltages are outputted from the drive signal voltage generators 34 and applied to the piezoelectric elements 20 are also shifted one cycle of a predetermined clock signal (see FIGS. 7(19) to (21)), and the peak current can also be prevented from becoming excessive.

Third Embodiment

Next, a third embodiment of the invention will be described. The same reference numerals will be given to portions that are the same as those of the second embodiment, and description of those portions will be omitted.

Figure 8:
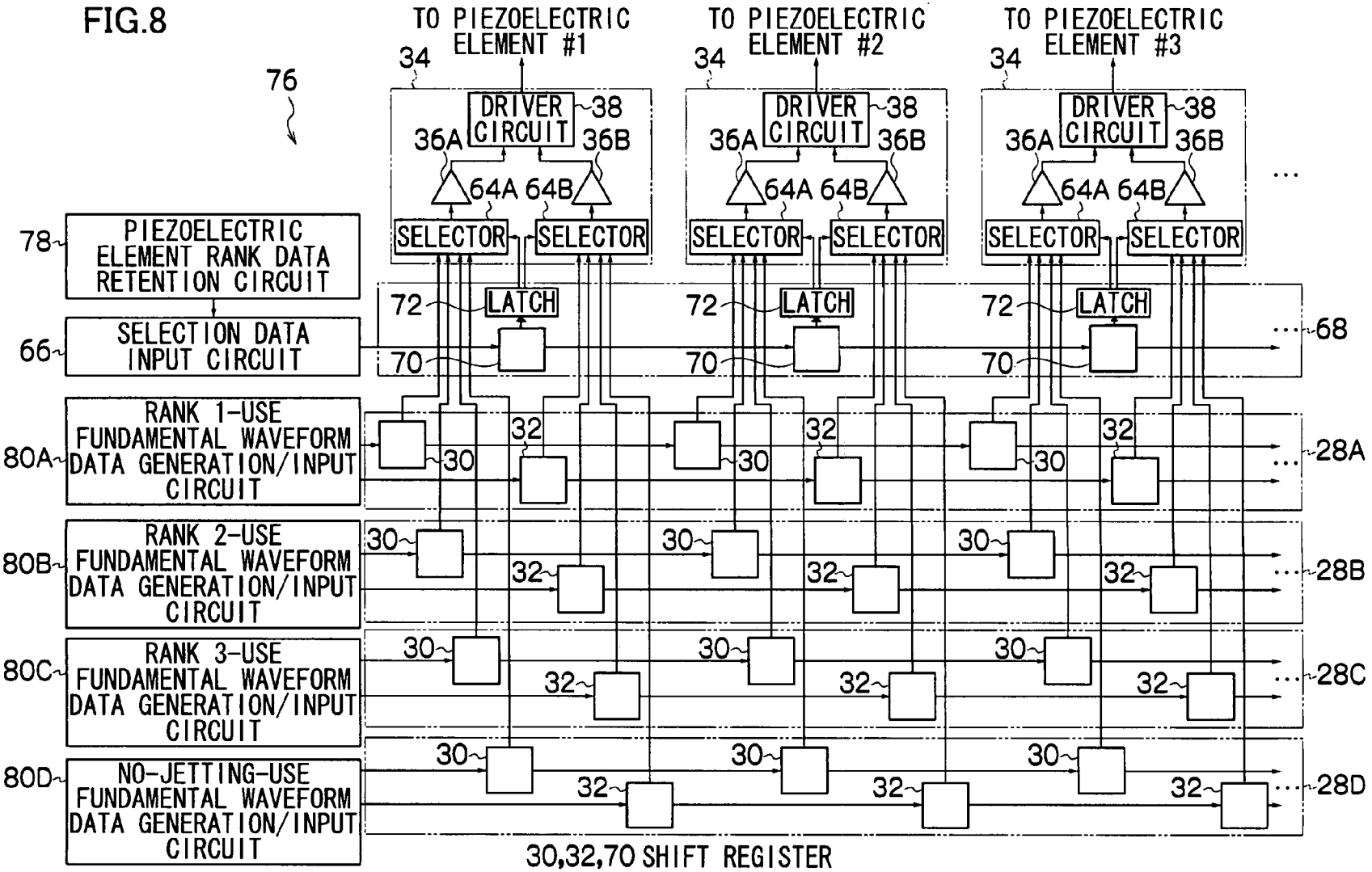
FIG. 8 is a block diagram showing the schematic configuration of a head drive unit pertaining to a third embodiment of the present invention.

As shown in FIG. 8, in a head drive unit 76 pertaining to the third embodiment, a piezoelectric element rank data retention circuit 78 is connected to the selection data input circuit 66. Numerous piezoelectric elements 20 are disposed in the liquid discharging head 10, and there are many instances where, due to variations in the characteristics of the piezoelectric elements 20, variations arise in the droplet quantities of the ink droplets discharged from the nozzles 18 when a constant voltage is applied to the piezoelectric elements 20. Variations in the droplet quantities of the ink droplets discharged from the nozzles 18 appear as variations in the sizes of the dots formed on the recording medium by the ink droplets discharged from the nozzles 18, and lead to a drop in the image quality of the image formed on the recording medium.

In the third embodiment, the characteristics (e.g., droplet quantities discharged when a constant drive signal voltage is applied, etc.) of the piezoelectric elements 20 disposed in the liquid discharging head 10 are measured beforehand (e.g., at the time the liquid discharging head 10 is manufactured, prior to shipping the inkjet printer device, etc.), and on the basis of the measurement results, the characteristics of the piezoelectric elements 20 are ranked from 1to 3. The piezoelectric element rank data retention circuit 78 is configured to include a nonvolatile memory. Rank data representing the rankings of the piezoelectric elements 20 are written and retained in the nonvolatile memory. The piezoelectric element rank data retention circuit 78 reads the rank data from the nonvolatile memory and outputs the rank data to the selection data input circuit 66 at the time of driving the liquid discharging head 10.

Instead of the previously described fundamental waveform data generation/input circuits 62A to 62D described in the second embodiment, the head drive unit 76 pertaining to the third embodiment is disposed with a rank 1-use fundamental waveform data generation/input circuit 80A, a rank 2-use fundamental waveform data generation/input circuit 80B, a rank 3-use fundamental waveform data generation/input circuit 80C and a no-jetting-use fundamental waveform data generation/input circuit 80D. With respect to these fundamental waveform data generation/input circuits 80A to 80D, the fundamental waveform data A and B stored in the built-in memories are different from each other. In the built-in memory of the rank 1-use fundamental waveform data generation/input circuit 80A are stored rank 1-use fundamental waveform data A and B for generating a drive signal voltage of a waveform determined so that ink droplets of a constant droplet quantity are discharged from the nozzles 18 corresponding to the piezoelectric elements 20 classified in rank 1. In the built-in memory of the rank 2-use fundamental waveform data generation/input circuit 80B are stored rank 2-use fundamental waveform data A and B for generating a drive signal voltage of a waveform determined so that ink droplets of a constant droplet quantity are discharged from the nozzles 18 corresponding to the piezoelectric elements 20 classified in rank 2. In the built-in memory of the rank 3-use fundamental waveform data generation/input circuit 80C are stored rank 3-use fundamental waveform data A and B for generating a drive signal voltage of a waveform determined so that ink droplets of a constant droplet quantity are discharged from the nozzles 18 corresponding to the piezoelectric elements 20 classified in rank 3.

In the built-in memory of the no-jetting-use fundamental waveform data generation/input circuit 80D are stored the same no-jetting-use fundamental waveform data A and B as the no-jetting-use fundamental waveform data generation/input circuit 62D described in the second embodiment. The rank 1-use, rank 2-use, rank 3-use and no-jetting-use fundamental waveform data A and B outputted from the fundamental waveform data generation/input circuits 80A to 80D are transferred by the shift register groups 28A to 28D in the same manner as in the second embodiment and inputted to the selectors 64A and 64B of the drive signal voltage generators 34.

In the third embodiment, the fundamental waveform data generation/input circuits 80A to 80D and the shift register groups 28A to 28D correspond to a fundamental waveform data supply component of the present invention, and the selectors 64A and 64B and the data transfer input unit 68 correspond to a first selection component of the present invention.

Next, the action of the third embodiment will be described. In the head drive unit 76 pertaining to the third embodiment, the rank data are read from the nonvolatile memory by the piezoelectric element rank data retention circuit 78 prior to the discharging of the ink droplets from the liquid discharging head 10, and the read rank data are outputted to the selection data input circuit 66.

The selection data input circuit 66 determines from which of the nozzles 18 ink droplets are to be discharged on the basis of image data (image data representing an image to be formed on the recording medium) inputted separately from the rank data, and generates selection data for each of the drive signal voltage generators 34 so that, with respect to the nozzles 18 that are not to discharge ink droplets, the no-jetting-use fundamental waveform data are selected from the rank 1-use, rank 2-use, rank 3-use and no-jetting-use fundamental waveform data inputted into the selectors 64A and 64B of the corresponding drive signal voltage generators 34, and with respect to the nozzles 18 that are to discharge ink droplets, the fundamental waveform data (any of the rank 1-use, rank 2-use and rank 3-use) corresponding to the ranks of the piezoelectric elements 20 that can be determined from the rank data are selected from the rank 1-use, rank 2-use, rank 3-use and no-jetting-use fundamental waveform data inputted into the selectors 64A and 64B of the corresponding drive signal voltage generators 34, and the selection data input circuit 66 sequentially outputs the generated selection data using, as a unit, selection data corresponding to a single drive signal voltage generator 34. The aforementioned selection data correspond to selection data of the invention.

The selection data sequentially outputted from the selection data input circuit 66 are transferred by the shift register row of the data transfer input unit 68 and retained in the latches 72, whereby the selection data are inputted to the selectors 64A and 64B of the corresponding drive signal voltage generators 34. Of the rank 1-use, rank 2-use, rank 3-use and no-jetting-use fundamental waveform data inputted via the shift register groups 28A to 28D from the fundamental waveform data generation/input circuits 80A to 80D, the selectors 64A and 64B output, to the booster circuits 36A and 36B, the fundamental waveform data for which selection has been instructed by the selection data inputted to the control signal input ends via the data transfer input unit 68 from the selection data input circuit 66.

Thus, on the basis of the fundamental waveform data outputted from the selectors 64A and 64B, the drive signal voltages outputted via the booster circuits 36A and 36B and the driver circuits 38 and applied to the piezoelectric elements 20 become waveforms corresponding to the type (rank 1-use, rank 2-use, rank 3-use, and no-jetting-use) of fundamental waveform data outputted from the selectors 64A and 64B, and the waveforms of the drive signal voltages applied to the piezoelectric elements 20 are independently controlled for each piezoelectric element 20 in accordance with the selection data inputted to the selectors 64A and 64B of the drive signal voltage generators 34 corresponding to the piezoelectric elements 20.

In the third embodiment, the rank-use fundamental waveform data are data for generating drive signal voltages of waveforms determined so that ink droplets of a constant droplet quantity are discharged from the nozzles 18 corresponding to the piezoelectric elements 20 classified into ranks. In the head drive unit 76 pertaining to the third embodiment, fundamental waveform data corresponding to the ranks of the piezoelectric elements 20 are selected with respect to the piezoelectric elements 20 corresponding to the nozzles 18 that are to discharge ink droplets, whereby drive signal voltages of waveforms corresponding to the ranks of the piezoelectric elements 20 are applied to the piezoelectric elements 20. Thus, head characteristic correction, which corrects variations in dot diameters resulting from variations in the characteristics of the piezoelectric elements 20 disposed in the liquid discharging head 10, can be realized, and high image quality of the image formed on the recording medium can be realized by this dot diameter modulation.

In the third embodiment also, the rank 1-use, rank 2-use, rank 3-use and no-jetting-use fundamental waveform data A and B sequentially outputted one bit at a time from the fundamental waveform data generation/input circuits 80A to 80D are sequentially transferred by the shift register groups 28A to 28D and inputted to the drive signal voltage generators 34 corresponding to the piezoelectric elements 20, whereby the timings at which the rank 1-use, rank 2-use, rank 3-use and no-jetting-use fundamental waveform data A and B are inputted to the drive signal voltage generators 34 are shifted one cycle of a predetermined clock signal. Thus, the timings at which the drive signal voltages are outputted from the drive signal voltage generators 34 and applied to the piezoelectric elements 20 are also shifted one cycle of a predetermined clock signal, and the peak current can also be prevented from becoming excessive.

Fourth Embodiment

Next, a fourth embodiment of the invention will be described. The same reference numerals will be given to portions that are the same as those of the second and third embodiments, and description of those portions will be omitted.

Figure 9:
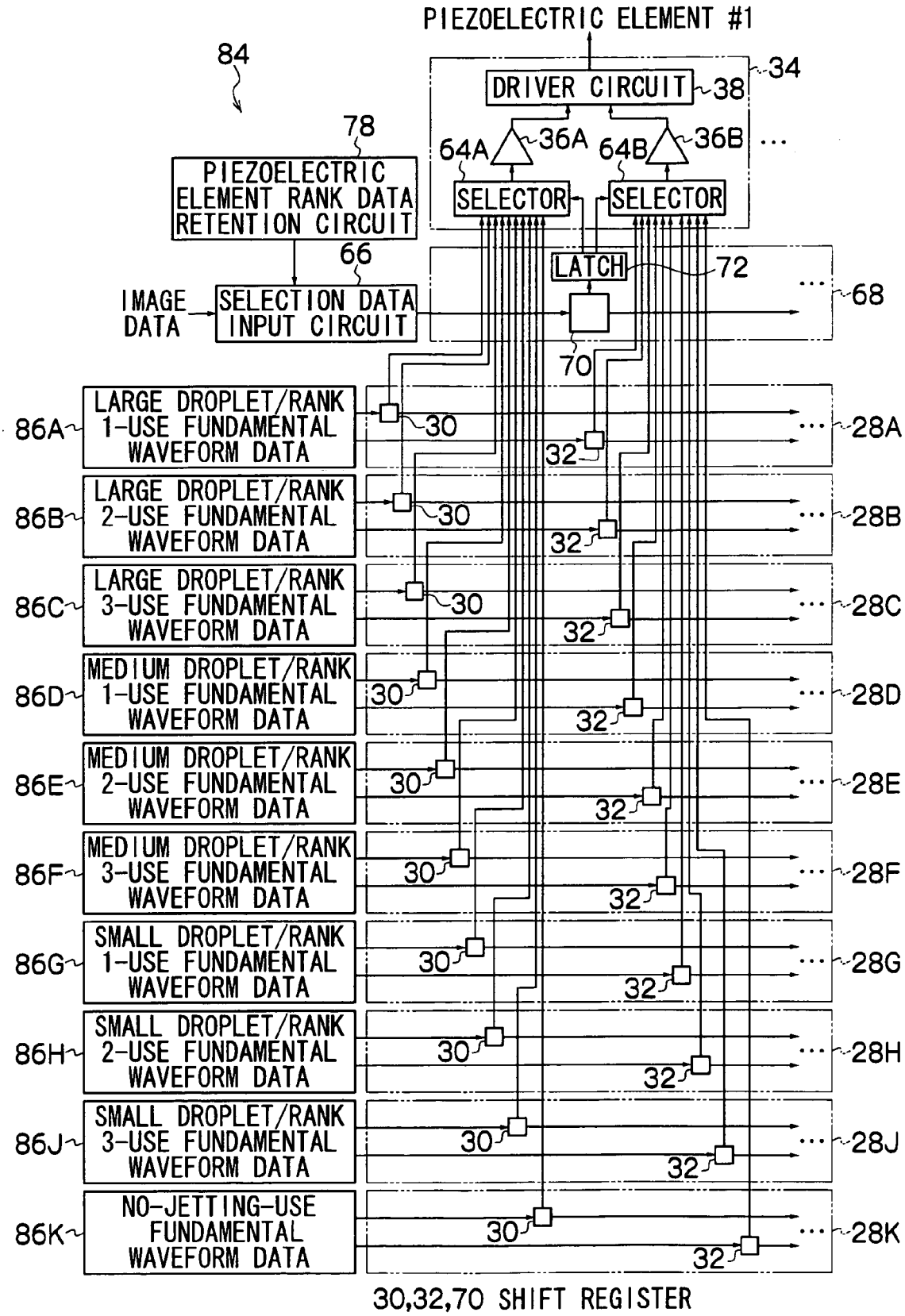
FIG. 9 is a block diagram showing the schematic configuration of a head drive unit pertaining to a fourth embodiment of the present invention.

As shown in FIG. 9, in a head drive unit 84 pertaining to the fourth embodiment, similar to the third embodiment, the piezoelectric element rank data retention circuit 78 is connected to the selection data input circuit 66. Also, in the fourth embodiment, a large droplet/rank 1-use fundamental waveform data generation/input circuit 86A, a large droplet/rank 2-use fundamental waveform data generation/input circuit 86B, a large droplet/rank 3-use fundamental waveform data generation/input circuit 86C, a medium droplet/rank 1-use fundamental waveform data generation/input circuit 86D, a medium droplet/rank 2-use fundamental waveform data generation/input circuit 86E, a medium droplet/rank 3-use fundamental waveform data generation/input circuit 86F, a small droplet/rank 1-use fundamental waveform data generation/input circuit 86G, a small droplet/rank 2-use fundamental waveform data generation/input circuit 86H, a small droplet/rank 3-use fundamental waveform data generation/input circuit 86J and a no-jetting-use fundamental waveform data generation/input circuit 86K are disposed as fundamental waveform data generation/input circuits. Ten shift register groups 28A to 28K are disposed in correspondence to these fundamental waveform data generation/input circuits.

In the built-in memory of the large droplet/rank 1-use fundamental waveform data generation/input circuit 86A are stored large droplet/rank 1-use fundamental waveform data A and B for generating a drive signal voltage of a waveform determined so that large ink droplets are discharged from the nozzles 18 corresponding to the piezoelectric elements 20 classified in rank 1. Similarly, in the built-in memory of the large droplet/rank 2-use fundamental waveform data generation/input circuit 86B are stored large droplet/rank 2-use fundamental waveform data A and B for generating a drive signal voltage of a waveform determined so that large ink droplets are discharged from the nozzles 18 corresponding to the piezoelectric elements 20 classified in rank 2. In the built-in memory of the large droplet/rank 3-use fundamental waveform data generation/input circuit 86C are stored large droplet/rank 3-use fundamental waveform data A and B for generating a drive signal voltage of a waveform determined so that large ink droplets are discharged from the nozzles 18 corresponding to the piezoelectric elements 20 classified in rank 3. In the built-in memory of the medium droplet/rank 1-use fundamental waveform data generation/input circuit 86D are stored medium droplet/rank 1-use fundamental waveform data A and B for generating a drive signal voltage of a waveform determined so that medium ink droplets are discharged from the nozzles 18 corresponding to the piezoelectric elements 20 classified in rank 1. In the built-in memory of the medium droplet/rank 2-use fundamental waveform data generation/input circuit 86E are stored medium droplet/rank 2-use fundamental waveform data A and B for generating a drive signal voltage of a waveform determined so that medium ink droplets are discharged from the nozzles 18 corresponding to the piezoelectric elements 20 classified in rank 2. In the built-in memory of the medium droplet/rank 3-use fundamental waveform data generation/input circuit 86F are stored medium droplet/rank 3—use fundamental waveform data A and B for generating a drive signal voltage of a waveform determined so that medium ink droplets are discharged from the nozzles 18 corresponding to the piezoelectric elements 20 classified in rank 3. In the built-in memory of the small droplet/rank 1-use fundamental waveform data generation/input circuit 86G are stored small droplet/rank 1-use fundamental waveform data A and B for generating a drive signal voltage of a waveform determined so that small ink droplets are discharged from the nozzles 18 corresponding to the piezoelectric elements 20 classified in rank 1. In the built-in memory of the small droplet/rank 2-use fundamental waveform data generation/input circuit 86H are stored small droplet/rank 2-use fundamental waveform data A and B for generating a drive signal voltage of a waveform determined so that small ink droplets are discharged from the nozzles 18 corresponding to the piezoelectric elements 20 classified in rank 2. In the built-in memory of the small droplet/rank 3-use fundamental waveform data generation/input circuit 86J are stored small droplet/rank 3-use fundamental waveform data A and B for generating a drive signal voltage of a waveform determined so that small ink droplets are discharged from the nozzles 18 corresponding to the piezoelectric elements 20 classified in rank 3.

In the built-in memory of the no-jetting-use fundamental waveform data generation/input circuit 86K are stored the same no-jetting-use fundamental waveform data A and B as the no-jetting-use fundamental waveform data generation/input circuit 62D described in the second embodiment. The large droplet/rank 1-use, large droplet/rank 2-use, large droplet/rank 3-use, medium droplet/rank 1-use, medium droplet/rank 2-use, medium droplet/rank 3-use, small droplet/rank 1-use, small droplet/rank 2-use, small droplet/rank 3-use and no-jetting-use fundamental waveform data A and B outputted from the fundamental waveform data generation/input circuits 86A to 86K are transferred by the shift register groups 28A to 28K in the same manner as in the second and third embodiments and inputted to the selectors 64A and 64B of the drive signal voltage generators 34.

In the fourth embodiment, the fundamental waveform data generation/input circuits 86A to 86K and the shift register groups 28A to 28K correspond to a fundamental waveform data supply component of the present invention, and the selectors 64A and 64B and the data transfer input unit 68 correspond to a first selection component of the present invention.

Next, the action of the fourth embodiment will be described. In the head drive unit 84 pertaining to the fourth embodiment, from which of the nozzles 18 are the ink droplets to be discharged and the droplet quantities (large/middle/small) of the ink droplets to be discharged are determined, prior to the discharging of the ink droplets from the liquid discharging head 10, by the selection data input circuit 66 on the basis of image data representing an image to be formed on the recording medium, and the ranks of the piezoelectric elements 20 corresponding to the nozzles 18 are identified on the basis of the rank data inputted from the piezoelectric element rank data retention circuit 78. Then, the selection data input circuit 66 generates selection data for each of the drive signal voltage generators 34 so that, in the selectors 64A and 64B of the drive signal voltage generators 34 corresponding to the nozzles 18 that are not to discharge ink droplets, the no-jetting-use fundamental waveform data are selected from the inputted fundamental waveform data, and in the selectors 64A and 64B of the drive signal voltage generators 34 corresponding to the nozzles 18 that are to discharge ink droplets, the fundamental waveform data corresponding to the previously determined droplet quantities and ranks of the piezoelectric elements 20 are selected from the inputted fundamental waveform data, and the selection data input circuit 66 sequentially outputs the generated selection data using, as a unit, selection data corresponding to a single drive signal voltage generator 34.

In the fourth embodiment also, similar to the second and third embodiments, the selection data sequentially outputted from the selection data input circuit 66 are inputted to the selectors 64A and 64B of the drive signal voltage generators 34 via the data transfer input unit 68. Of the large droplet/rank 1-use, large droplet/rank 2-use, large droplet/rank 3-use, medium droplet/rank 1-use, medium droplet/rank 2-use, medium droplet/rank 3-use, small droplet/rank 1-use, small droplet/rank 2-use, small droplet/rank 3-use and no-jetting-use fundamental waveform data inputted via the shift register groups 28A to 28K from the fundamental waveform data generation/input circuits 86A to 86K, the selectors 64A and 64B of the drive signal voltage generators 34 selectively output, to the booster circuits 36A and 36B, the fundamental waveform data for which selection has been instructed by the selection data inputted to the control signal input ends via the data transfer input unit 68 from the selection data input circuit 66.

Thus, on the basis of the fundamental waveform data outputted from the selectors 64A and 64B, the drive signal voltages outputted via the booster circuits 36A and 36B and the driver circuits 38 and applied to the piezoelectric elements 20 become waveforms corresponding to the type of fundamental waveform data outputted from the selectors 64A and 64B, and the waveforms of the drive signal voltages applied to the piezoelectric elements 20 are independently controlled for each piezoelectric element 20 in accordance with the selection data inputted to the selectors 64A and 64B of the drive signal voltage generators 34 corresponding to the piezoelectric elements 20. In this manner, the head drive unit 84 pertaining to the fourth embodiment can simultaneously realize dot diameter modulation and head characteristic correction, and can realize high image quality of an image to be formed on a recording medium by the dot diameter modulation and head characteristic correction.

In the fourth embodiment also, the fundamental waveform data sequentially outputted from the fundamental waveform data generation/input circuits 86A to 86K are sequentially transferred by the shift register groups 28A to 28K and inputted to the drive signal voltage generators 34 corresponding to the piezoelectric elements 20, whereby the timings at which the fundamental waveform data A and B are inputted to the drive signal voltage generators 34 are shifted one cycle of a predetermined clock signal. Thus, the timings at which the drive signal voltages are outputted from the drive signal voltage generators 34 and applied to the piezoelectric elements 20 are also shifted one cycle of a predetermined clock signal, and the peak current can also be prevented from becoming excessive.

Fifth Embodiment

Next, a fifth embodiment of the invention will be described. The same reference numerals will be given to portions that are the same as those of the second embodiment, and description of those portions will be omitted.

Figure 10:
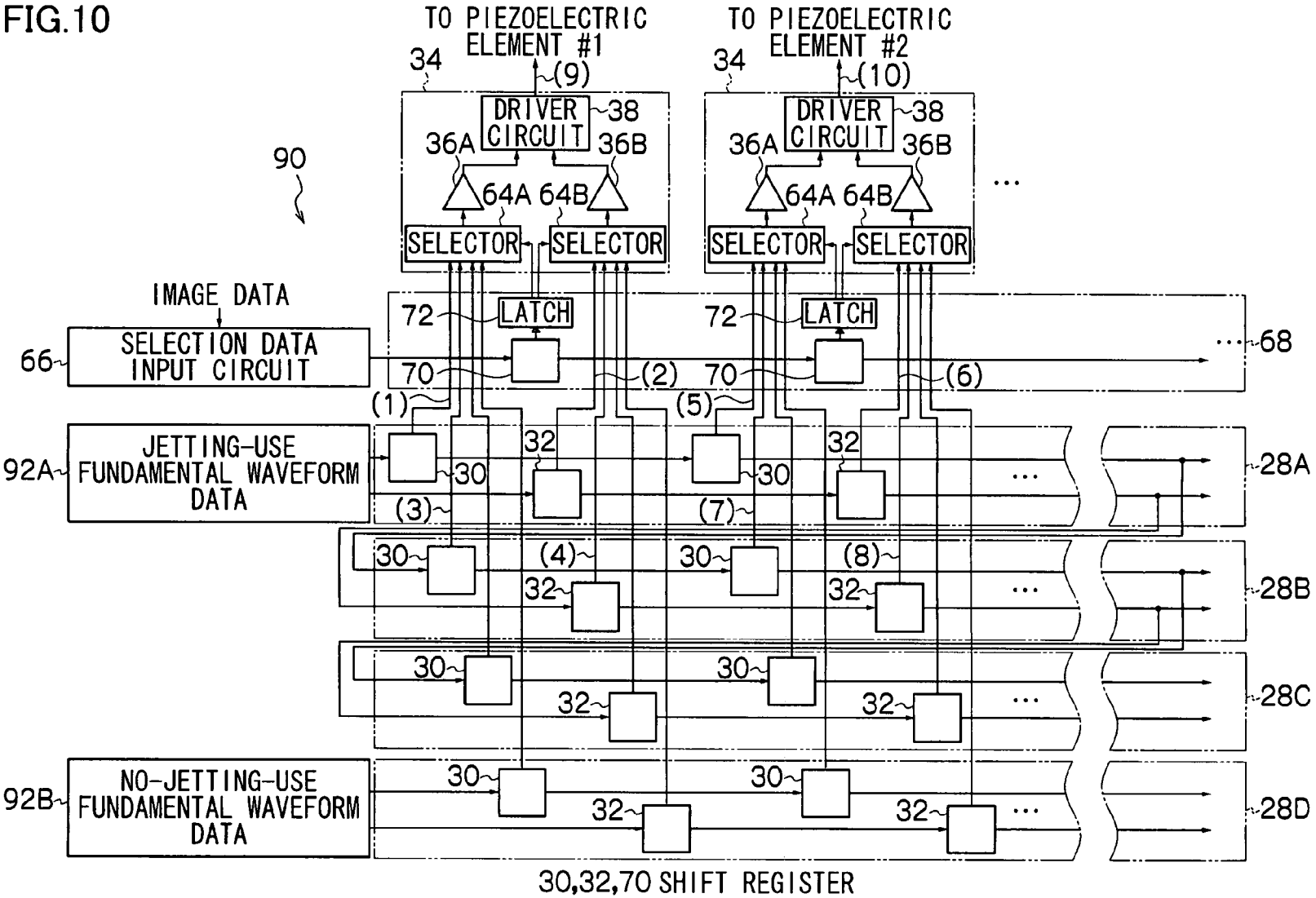
FIG. 10 is a block diagram showing the schematic configuration of a head drive unit pertaining to a fifth embodiment of the present invention.

As shown in FIG. 10, in a head drive unit 90 pertaining to the fifth embodiment, only a jetting-use fundamental waveform data generation/input circuit 92A and a no-jetting-use fundamental waveform data generation/input circuit 92B are disposed as the fundamental waveform data generation/input circuits. In the built-in memory of the jetting-use fundamental waveform data generation/input circuit 92A are stored jetting-use fundamental waveform data A and B for generating a drive signal voltage of a waveform determined so that small ink droplets of a predetermined droplet quantity are discharged from the nozzles 18 corresponding to the piezoelectric elements 20. In the built-in memory of the no-jetting-use fundamental waveform data generation/input circuit 92B are stored the same no-jetting-use fundamental waveform data A and B as the no-jetting-use fundamental waveform data generation/input circuit 62D described in the second embodiment.

Also, the head drive unit 90 pertaining to the fifth embodiment is disposed with three shift register groups 28A to 28C, which are for transferring the jetting-use fundamental waveform data A and B outputted from the jetting-use fundamental waveform data generation/input circuit 92A, and one shift register group 28D, which is for transferring the no-jetting-use fundamental waveform data A and B outputted from the no-jetting-use fundamental waveform data generation/input circuit 92B. Output ends of the shift registers 30 and 32 at the tail of the shift register group 28A are connected to input ends of the shift registers 30 and 32 at the head of the shift register group 28B, and output ends of the shift registers 30 and 32 at the tail of the shift register group 28B are connected to input ends of the shift registers 30 and 32 at the head of the shift register group 28C. Thus, the jetting-use fundamental waveform data A and B outputted from the jetting-use fundamental waveform data generation/input circuit 92A are transferred in order through the shift register groups 28A, 28B and 28C.

Figure 11:
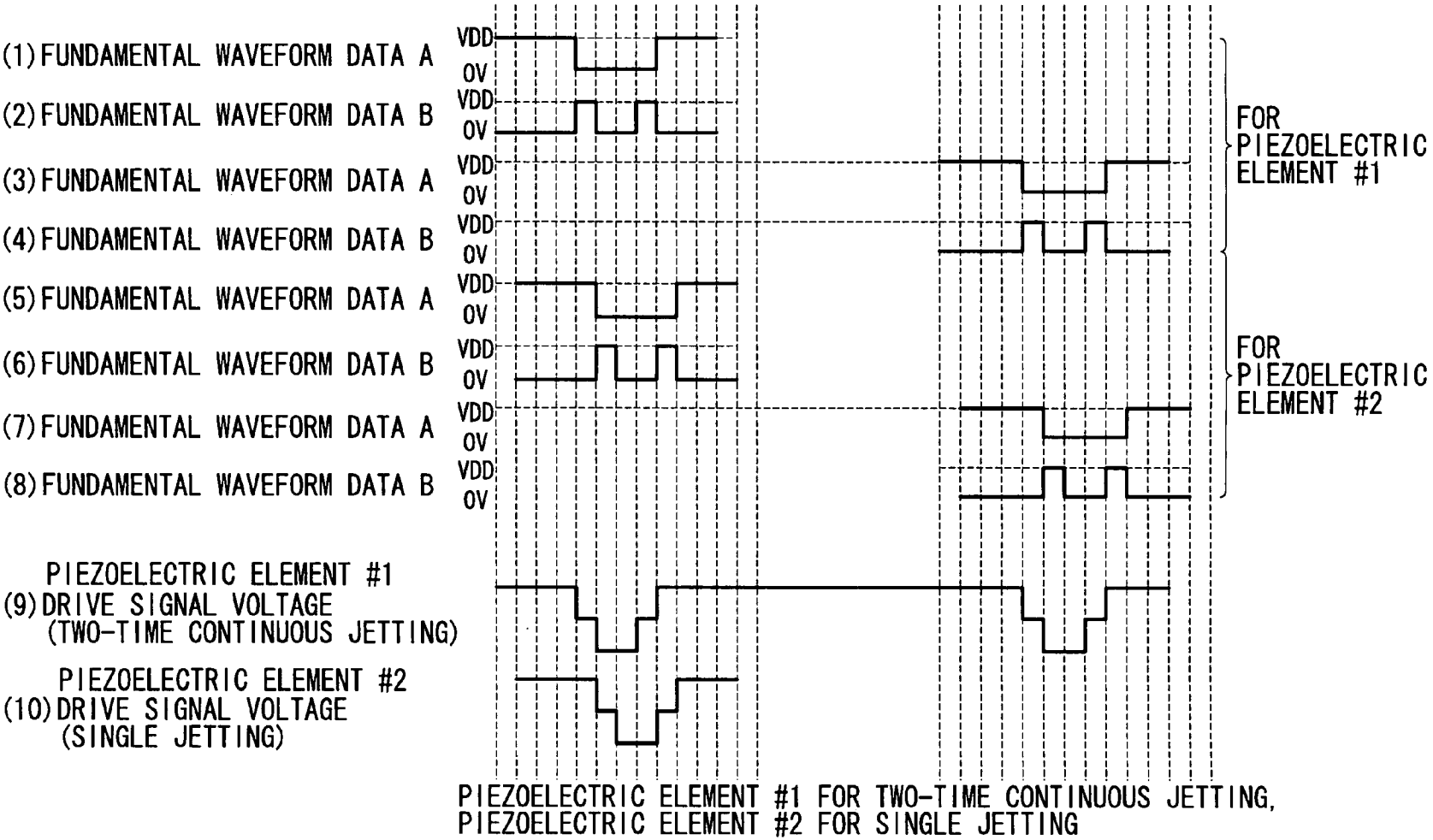
FIG. 11 is a timing chart of data (voltages) flowing through each part of the head drive unit pertaining to the fifth embodiment of the present invention.

Also, output ends of the shift registers 30 of the shift register groups 28A to 28D are connected to input ends of the selectors 64A of the corresponding drive signal voltage generators 34, and output ends of the shift registers 32 of the shift register groups 28A to 28D are connected to input ends of the selectors 64B of the corresponding drive signal voltage generators 34. Thus, the no-jetting-use fundamental waveform data A and B outputted from the no-jetting-use fundamental waveform data generation/input circuit 92B are inputted only once to the selectors 64A and 64B of the drive signal voltage generators 34, but the jetting-use fundamental waveform data A and B outputted from the jetting-use fundamental waveform data generation/input circuit 92A are repeatedly inputted three times to the selectors 64A and 64B of the drive signal voltage generators 34, as shown in FIGS. 11(1) to (8) for example, while the jetting-use fundamental waveform data A and B are transferred in order through the shift register groups 28A, 28B and 28C.

In the fifth embodiment, the fundamental waveform data generation/input circuits 92A and 92B and the shift register groups 28A to 28D correspond to a fundamental waveform data supply component of the present invention, and the selectors 64A and 64B and the data transfer input unit 68 correspond to a second selection component of the invention.

Next, the action of the fifth embodiment will be described. The selection data input circuit 66 pertaining to the fifth embodiment determines, on the basis of image data representing an image to be formed on the recording medium, from which of the nozzles 18 are the ink droplets to be discharged and the droplet quantities (the sizes of dots to be formed on the recording medium by the discharged ink droplets) of the ink droplets to be discharged, and sets the number of times that ink droplets are to be discharged from the nozzles 18 on the basis of the determined droplet quantities (e.g., droplet quantities: large=jetting three times; droplet quantity: medium=jetting two times; droplet quantity: small=jetting one time). Then, the selection data input circuit 66 generates selection data for each of the drive signal voltage generators 34 so that, in the selectors 64A and 64B of the drive signal voltage generators 34 corresponding to the nozzles 18 that are not to discharge ink droplets, the no-jetting-use fundamental waveform data are selected from the inputted fundamental waveform data, and in the selectors 64A and 64B of the drive signal voltage generators 34 corresponding to the nozzles 18 that are to discharge ink droplets, the jetting-use fundamental waveform data for the previously set number of jetting times are sequentially selected from the jetting-use fundamental waveform data repeatedly inputted three times, and the selection data input circuit 66 sequentially outputs the generated selection data using, as a unit, selection data corresponding to a single drive signal voltage generator 34. The selection data sequentially outputted from the selection data input circuit 66 are inputted to the selectors 64A and 64B of the drive signal voltage generators 34 via the data transfer input unit 68, and the selectors 64A and 64B of the drive signal voltage generators 34 select, from the inputted jetting-use/no-jetting-use fundamental waveform data, the fundamental waveform data for which selection has been instructed by the inputted selection data and output the fundamental waveform data to the booster circuits 36A and 36B.

Here, the selectors 64A and 64B of the drive signal voltage generators 34 corresponding to the nozzles 18 whose number of times to discharge ink droplets has been set to several times (two or three times) sequentially select and output, from the jetting-use fundamental waveform data repeatedly inputted three times, the jetting-use fundamental waveform data for the set number of jetting times in accordance with the inputted selection data. Thus, in regard to the nozzles 18 whose number of times to discharge ink droplets has been set to several times, the drive signal voltage generated on the basis of the jetting-use fundamental waveform data A and B is applied several times to the corresponding piezoelectric elements 20 as shown in FIG. 11(9) for example (FIG. 11(9) shows a case where two times has been set as the number of jetting times), and the ink droplets are discharged only for the set number of jetting times.

The sizes of the dots formed on the recording medium by the ink droplets discharged from the nozzles 18 of the liquid discharging head 10 are dependent on the number of times the ink droplets are discharged from the nozzles 18. Thus, the head drive unit 90 pertaining to the fifth embodiment switches the droplet quantities of the ink droplets discharged from the nozzles 18, whereby dot diameter modulation, in which the sizes of the dots formed on the recording medium by the ink droplets discharged from the nozzles 18 are switched for each nozzle 18 (each piezoelectric element) in accordance with the image to be formed on the recording medium, can be realized, and high image quality of the image formed on the recording medium can be realized by this dot diameter modulation.

Figure 12:
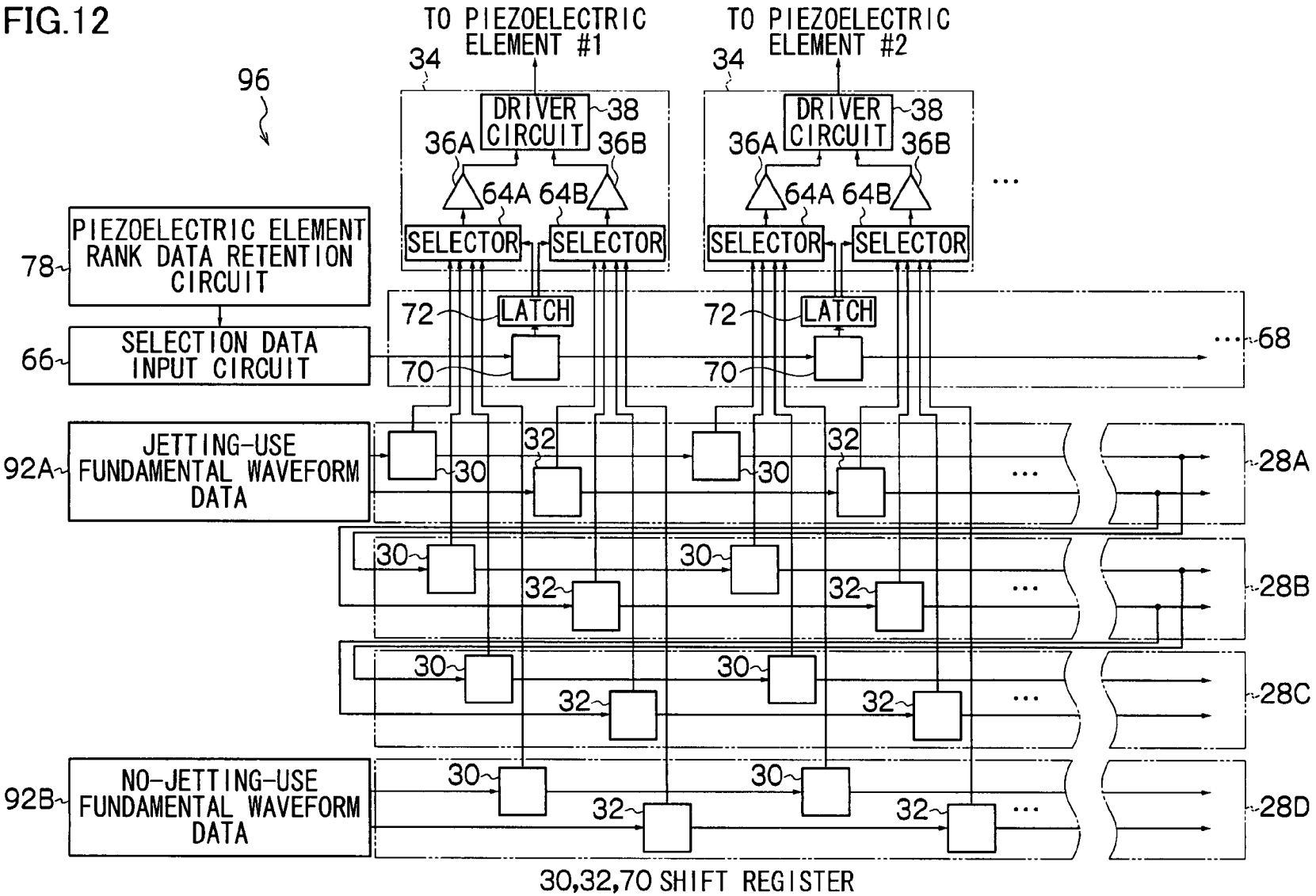
FIG. 12 is a block diagram showing another example of the schematic configuration of the head drive unit.

In the fifth embodiment, the number of times the ink droplets are discharged from the nozzles 18 is not limited to being determined on the basis of image data representing an image to be formed on the recording medium. For example, similar to the third embodiment, the number of times the ink droplets are to be discharged from the nozzles 18 may be determined on the basis of rank data obtained by ranking the characteristics of the piezoelectric elements 20 (FIG. 12 shows a head drive unit 96 configured to determine the number of times the ink droplets are to be discharged from the nozzles 18 on the basis of rank data). Or, similar to the fourth embodiment, the number of times the ink droplets are to be discharged from the nozzles 18 may be determined on the basis of rank data and image data representing an image to be formed on the recording medium.

Also, in the fifth embodiment, a configuration was described where the jetting-use fundamental waveform data were transferred in order through the three shift register groups 28A, 28B and 28C, but the number of shift register groups may also be two, or four or more. Also, in the fifth embodiment, a configuration was described where the output ends of the shift registers 30 and 32 at the tail of a previous shift register group were connected to input ends of the shift registers 30 and 32 at the head of the next shift register group, but the invention is not limited to this and may also be configured so that the output ends of shift registers 30 and 32 positioned in the intermediate portion (other than the head and tail) of the shift register rows A and B of a previous shift register group are connected to input ends of shift registers 30 and 32 at the head of the next shift register group. Also, plural shift register groups that transfer one type of fundamental waveform data may be plurally disposed to transfer mutually different fundamental waveform data.

Also, in the above description, an example was described where two types of fundamental waveform data (the fundamental waveform data A and B) were generated/outputted as the fundamental waveform data for generating a single drive signal voltage whose voltage level changes in three stages, but the invention is not limited to this. The invention may also be configured so that three or more types of fundamental waveform data are outputted from a single fundamental waveform data generation/input circuit as the fundamental waveform data for generating a single drive signal voltage whose voltage level changes in three stages.

As described above, a drive device of a first aspect of the invention drives a liquid discharging head to discharge, in accompaniment with the application of a drive signal voltage to a drive element, recording droplets from a nozzle disposed with that drive element, the drive device including: a fundamental waveform data supply component that generates/supplies plural types of fundamental waveform data representing fundamental waveforms whose voltage level changes in two stages; and a drive signal voltage generation component that generates plural types of fundamental waveform voltages by boosting, to mutually different voltage levels, the plural types of fundamental waveform data supplied from the fundamental waveform data supply component, and which generates a drive signal voltage whose voltage level changes in at least three stages by switching, in accordance with an inputted selection signal, the fundamental waveform voltage to be selectively outputted as the drive signal voltage from the generated plural types of fundamental waveform voltages.

The liquid discharging head drive device of the first aspect is a device that drives a liquid discharging head to discharge, in accompaniment with the application of a drive signal voltage to a drive element (preferably a piezoelectric element, but may also be a heater element), recording droplets from a nozzle disposed with that drive element. In the first aspect, plural types of fundamental waveform data representing fundamental waveforms whose voltage level changes in two stages are generated/supplied by the fundamental waveform data supply component. The fundamental waveform data are data representing fundamental waveforms whose voltage level changes in two stages. For example, data representing, in two values (e.g., 0/1), a voltage level at the timing of a change in the voltage level of a fundamental waveform and during the change timing can be applied. Thus, the first aspect can realize, with a simple configuration, a fundamental waveform data supply component that generates/supplies fundamental waveform data notwithstanding generating a drive signal voltage whose voltage level changes in at least three stages.

The drive signal voltage generation component of the first aspect generates plural types of fundamental waveform voltages by boosting, to mutually different voltage levels, the plural types of fundamental waveform data supplied from the fundamental waveform data supply component. Thus, plural fundamental waveform voltages are obtained where at least one of an L (low) level and an H (high) level of the voltage levels of the fundamental waveforms that the fundamental waveform data represents is boosted to mutually different voltage levels. Then, the drive signal voltage generation component generates a drive signal voltage whose voltage level changes in at least three stages by switching, in accordance with an inputted selection signal, the fundamental waveform voltage to be selectively outputted as the drive signal voltage from the generated plural types of fundamental waveform voltages.

In the first aspect, the plural types of fundamental waveforms represented by the plural types of fundamental waveform data generated/supplied by the fundamental waveform data supply component are changed (the timing of a change in the voltage level, the voltage level during the timing of that change, or the number of changes in the voltage level are changed), whereby the waveform (the timing of a change in the voltage level, the voltage level during the timing of that change, or the number of changes in the voltage level) of the generated drive signal voltage changes. Thus, the drive signal voltage can be made into a waveform where the meniscus can be controlled with high precision, and changing the waveform of the drive signal voltage for dot diameter modulation and head characteristic correction can be easily realized by changing the plural types of fundamental waveform data used to generate the drive signal voltage. Thus, according to the first aspect, generating a drive signal voltage of a desired waveform whose voltage level changes in at least three stages can be realized with a simple configuration. Also, when generating a drive signal voltage whose voltage level changes in at least three stages, it is not necessary to use a voltage dividing circuit in which plural resistors and plural transistors are combined, whereby the power consumption can also be reduced.

In the first aspect, when plural drive elements and plural nozzles are disposed in the liquid discharging head, plural drive signal voltage generation components are disposed in correspondence to the drive elements, and the fundamental waveform data supply component may supply the plural types of fundamental waveform data at shifted timings to the individual drive signal voltage generation components corresponding to the individual drive elements. In this case, it is preferable for the fundamental waveform data supply component to supply the plural types of fundamental waveform data at shifted timings to the individual drive signal voltage generation components corresponding to the individual drive elements. In this manner, by shifting the timings at which the plural types of fundamental waveform data are supplied to the individual drive signal voltage generation components, the timings at which the drive signal voltages are applied to the drive elements plurally disposed in the liquid discharging head (the timings at which recording droplets are discharged from the nozzles) are also shifted, whereby the peak current can be prevented from becoming excessive.

It is preferable for the fundamental waveform data supply component to supply the fundamental waveform data at shifted timings to the individual drive signal voltage generation components corresponding to the individual drive elements by sequentially transferring the plural types of fundamental waveform data with a shift register row where shift registers plurally disposed in correspondence to the individual drive signal voltage generation components are serially connected, for example. Thus, the configuration can be simplified and complex control becomes unnecessary because a storage circuit for storing timings at which large currents flow and a circuit for determining whether or not the timings at which the large currents flow overlap become unnecessary.

In the first aspect, when the drive element is a piezoelectric element, it is preferable for the drive device to further include a selection signal generation component that generates, as a selection signal inputted to the drive signal voltage generation component, a signal that creates, for a predetermined time, a no-output period where none of the plural fundamental waveform voltages are outputted at the time of switching the fundamental waveform voltage outputted as the drive signal voltage. A piezoelectric elements is electrically substantially equivalent to a capacitor, and even if a no-output period is created for a predetermined time at the time of switching the fundamental waveform voltage outputted as the drive signal voltage, the change in the voltage of both ends of the piezoelectric element during the no-output period is slight, so that by creating a no-output period for a predetermined time, back-flow of the current can be prevented from occurring at the time of switching the fundamental waveform voltage.

In the first aspect, the fundamental waveform data supply component may generate/supply, as fundamental waveform data groups comprising the plural types of fundamental waveform data, plural fundamental waveform data groups individually determined so that mutually different drive signal voltages are generated by the drive signal voltage generation component, and the drive device may further include a first selection component that selects, in accordance with inputted selection data, the fundamental waveform data group to be selectively supplied to the drive signal voltage generation component from the plural fundamental waveform data groups supplied from the fundamental waveform data supply component.

As fundamental waveform data groups comprising the plural types of fundamental waveform data, plural fundamental waveform data groups individually determined so that mutually different drive signal voltages are generated by the drive signal voltage generation component are generated/supplied by the fundamental waveform data supply component. Also, the fundamental waveform data group to be selectively supplied to the drive signal voltage generation component from the plural fundamental waveform data groups supplied from the fundamental waveform data supply component is selected by a first selection component in accordance with inputted selection data. Thus, the waveform of the drive signal voltage changes (switches) in accordance with the fundamental waveform data group selected by the first selection component and supplied to the drive signal voltage generation component, the quantities of the recording droplets discharged from the nozzles change in accordance with the change of the waveform of the drive signal voltage, and the dot diameters formed on the recording medium change. Thus, changing the waveform of the drive signal voltage whose voltage level changes in at least three stages and changing the diameters of the dots formed on the recording medium can be realized without changing the fundamental waveform data supplied by the fundamental waveform data supply component, and the configuration of the device can be simplified.

When plural drive elements and plural nozzles are disposed in the liquid discharging head and plural drive signal voltage generation components are disposed in correspondence to the individual drive elements, plural first selection components may be disposed in correspondence to the individual drive elements. Thus, the waveforms of the drive signal voltages applied to the individual drive elements can be independently changed for each drive element, and the diameters of the dots formed on the recording medium can be independently changed for each drive element.

In the first aspect, the fundamental waveform data supply component may be configured to supply the plural types of fundamental waveform data to the drive signal voltage generation component several times, and the drive device may further include a second selection component that selects, in accordance with inputted selection data, the number of times that the plural types of fundamental waveform data are to be supplied to the drive signal voltage generation component.

The fundamental waveform data supply component is configured to supply the plural types of fundamental waveform data to the drive signal voltage generation component several times, and the number of times that the plural types of fundamental waveform data are to be supplied to the drive signal voltage generation component is selected by a second selection component in accordance with inputted selection data. Thus, the number of times that the plural types of fundamental waveform data are supplied to the drive signal voltage generation component changes in accordance with the selection by the second selection component, and the number of times that the drive signal voltage is applied to the drive element changes, whereby the number of times that the recording droplets are discharged from the nozzle changes, and the diameters of the dots formed on the recording medium change. Thus, changing the number of times that the drive signal voltage is applied to the drive element and changing the diameters of the dots formed on the recording medium can be realized without changing the fundamental waveform data supplied by the fundamental waveform data supply component, and the configuration of the device can be simplified.

When plural drive elements and plural nozzles are disposed in the liquid discharging head and plural drive signal voltage generation components are disposed in correspondence to the individual drive elements, plural second selection components may be disposed in correspondence to the individual drive elements. Thus, the number of times that the drive signal voltages are applied to the individual drive elements can be independently changed for each drive element, and the diameters of the dots formed on the recording medium can be independently changed for each drive element.

Also, the selection data can be set in accordance with the diameters of the dots to be formed on the recording medium by the recording droplets discharged from the nozzle, for example. The diameters of the dots to be formed on the recording medium can be determined in accordance with an image to be formed on the recording medium, for example. Thus, dot diameter modulation, in which the sizes of the dots formed on the recording medium by the recording droplets discharged from the liquid discharging head are changed in accordance with the image to be formed on the recording medium, can be realized.

When plural drive elements and plural nozzles are disposed in the liquid discharging head and plural drive signal voltage generation components and plural first selection components or plural second selection components are disposed in correspondence to the individual drive elements, the selection data can be set for each drive element in accordance with dot diameters of dots to be formed on a recording medium determined in accordance with an image to be formed on the recording medium, for example. Thus, the quantities of the recording droplets discharged from the individual nozzles corresponding to the individual drive elements, or the number of times the recording droplets are discharged from the individual nozzles, independently change in accordance with the image to be formed on the recording medium, and in accompaniment with the change in the quantities of the recording droplets or the number of times the recording droplets are discharged, the dot diameters of the individual dots formed on the recording medium by the recording droplets discharged from the individual nozzles independently change. Thus, dot diameter modulation, in which the sizes of the dots formed on the recording medium by the recording droplets discharged from the liquid discharging head are switched for each nozzle (each drive element) in accordance with the image to be formed on the recording medium, can be realized.

When plural drive elements and plural nozzles are disposed in the liquid discharging head and plural drive signal voltage generation components and plural first selection components or plural second selection components are disposed in correspondence to the drive elements, the selection data can be set for each drive element in accordance with characteristics of the drive elements of the liquid discharging head being classified into plural ranks. Thus, the quantities of the recording droplets discharged from the individual nozzles corresponding to the individual drive elements, or the number of times the recording droplets are discharged from the individual nozzles, change in accordance with the classification of the characteristics of the corresponding drive elements, and in accompaniment with the change in the quantities of the recording droplets or the number of times the recording droplets are discharged, the dot diameters of the individual dots formed on the recording medium by the recording droplets discharged from the individual nozzles independently change. Thus, head characteristic correction, in which variations in the dot diameters resulting from variations in the characteristics of the individual drive elements disposed in the liquid discharging head are corrected for each drive element, can be realized.

What is claimed is:

1. A drive device that drives a liquid discharging head to discharge, in accompaniment with the application of a drive signal voltage to a drive element, recording droplets from a nozzle disposed with the drive element, the drive device comprising:

a fundamental waveform data supply component that generates/supplies plural types of fundamental waveform data representing fundamental waveforms whose voltage level changes in two stages; and a drive signal voltage generation component that generates plural types of fundamental waveform voltages by boosting, to mutually different voltage levels, the plural types of fundamental waveform data supplied from the fundamental waveform data supply component, and generates a drive signal voltage whose voltage level changes in at least three stages by switching, in accordance with an inputted selection signal, the fundamental waveform voltage to be selectively outputted as the drive signal voltage from the generated plural types of fundamental waveform voltages;

wherein the drive element is a piezoelectric element, and the drive device further comprises a selection signal generation component that generates, as a selection signal inputted to the drive signal voltage generation component, a signal that creates, for a predetermined time, a no-output period where none of the plural fundamental waveform voltages are outputted at the time of switching the fundamental waveform voltage outputted as the drive signal voltage.

2. The drive device of claim 1, wherein the fundamental waveform data are data representing, in two values, the timing of a change in the voltage level of a fundamental waveform and a voltage level during the change timing.

3. The drive device of claim 1, wherein the drive element and the nozzle are plurally disposed in the liquid discharging head, the drive signal voltage generation component is plurally disposed in correspondence to the drive elements, and the fundamental waveform data supply component supplies the plural types of fundamental waveform data at shifted timings to the individual drive signal voltage generation components corresponding to the individual drive elements.

4. The drive device of claim 3, wherein the fundamental waveform data supply component supplies the fundamental waveform data at shifted timings to the individual drive signal voltage generation components corresponding to the individual drive elements by sequentially transferring the plural types of fundamental waveform data with a shift register row where shift registers plurally disposed in correspondence to the individual drive signal voltage generation components are serially connected.

5. The drive device of claim 1, wherein the fundamental waveform data supply component generates/supplies, as fundamental waveform data groups comprising the plural types of fundamental waveform data, plural fundamental waveform data groups individually determined so that mutually different drive signal voltages are generated by the drive signal voltage generation component, and the drive device further comprises a first selection component that selects, in accordance with inputted selection data, the fundamental waveform data group to be selectively supplied to the drive signal voltage generation component from the plural fundamental waveform data groups supplied from the fundamental waveform data supply component.

6. The drive device of claim 1, wherein the fundamental waveform data supply component is configured to supply the plural types of fundamental waveform data to the drive signal voltage generation component several times, and the drive device further comprises a second selection component that selects, in accordance with inputted selection data, the number of times that the plural types of fundamental waveform data are to be supplied to the drive signal voltage generation component.

7. The drive device of claim 5, wherein the drive element and the nozzle are plurally disposed in the liquid discharging head, the drive signal voltage generation component and the first selection component are plurally disposed in correspondence to the individual drive elements, and the selection data are set for each drive element in accordance with dot diameters of dots to be formed on a recording medium determined in accordance with an image to be formed on the recording medium.

8. The drive device of claim 6, wherein the drive element and the nozzle are plurally disposed in the liquid discharging head, the drive signal voltage generation component and the second selection component are plurally disposed in correspondence to the individual drive elements, and the selection data are set for each drive element in accordance with dot diameters of dots to be formed on a recording medium determined in accordance with an image to be formed on the recording medium.

9. The drive device of claim 5, wherein the drive element and the nozzle are plurally disposed in the liquid discharging head, the drive signal voltage generation component and the first selection component are plurally disposed in correspondence to the drive elements, and the selection data are set for each drive element in accordance with said each drive element of the liquid discharging head being classified into plural ranks based on quantity characteristics of said each drive element of the liquid discharging head.

10. The drive device of claim 6, wherein the drive element and the nozzle are plurally disposed in the liquid discharging head, the drive signal voltage generation component and the second selection component are plurally disposed in correspondence to the individual drive elements, and the selection data are set for each drive element in accordance with said each drive element of the liquid discharging head being classified into plural ranks based on quantity characteristics of said each drive element of the liquid discharging head.

11. A method of driving a liquid discharging head to discharge, in accompaniment with the application of a drive signal voltage to a drive element, recording droplets from a nozzle disposed with that drive element, the drive method comprising:

generating/supplying plural types of fundamental waveform data representing fundamental waveforms whose voltage level changes in two stages; and generating plural types of fundamental waveform voltages by boosting, to mutually different voltage levels, the supplied plural types of fundamental waveform data, and generating a drive signal voltage whose voltage level changes in at least three stages by switching, in accordance with an inputted selection signal, the fundamental waveform voltage to be selectively outputted as the drive signal voltage from the generated plural types of fundamental waveform voltages;

wherein the drive element is a piezoelectric element, and as the selection signal, a signal is generated which creates, for a predetermined time, a no-output period where none of the plural fundamental waveform voltages are outputted at the time of switching the fundamental waveform voltage outputted as the drive signal voltage.

* * * * *